US008109278B2

(12) United States Patent
Lee

(10) Patent No.: US 8,109,278 B2
(45) Date of Patent: Feb. 7, 2012

(54) DYE CONTAINER AND HAIR DYEING DEVICE USING THE SAME

(76) Inventor: Jae-Kun Lee, Taegu (KR)

( * ) Notice: Subject to any disclaimer, the term of this patent is extended or adjusted under 35 U.S.C. 154(b) by 0 days.

(21) Appl. No.: 10/521,034

(22) PCT Filed: Jul. 23, 2003

(86) PCT No.: PCT/KR03/01458

§ 371 (c)(1),
(2), (4) Date: Jan. 12, 2005

(87) PCT Pub. No.: WO2004/010818

PCT Pub. Date: Feb. 5, 2004

(65) Prior Publication Data

US 2006/0021627 A1 Feb. 2, 2006

(30) Foreign Application Priority Data

Jul. 25, 2002 (KR) ..... 10-2002-0045708
Jul. 22, 2003 (KR) ..... 10-2003-0050388

(51) Int. Cl.
*A45D 24/22* (2006.01)

(52) U.S. Cl. ..... 132/113

(58) Field of Classification Search ..... 132/111–116, 132/119.1, 208, 271, 272; 222/95, 105, 106, 222/192, 145.5, 333; 401/188 R, 190
See application file for complete search history.

(56) References Cited

U.S. PATENT DOCUMENTS 3,702,616 A * 11/1972 Mercer ..... 132/272
3,721,250 A * 3/1973 Walter et al. ..... 132/112
4,592,376 A * 6/1986 Sigmund et al. ..... 132/112
4,691,720 A * 9/1987 Schmitz ..... 132/112
4,792,250 A * 12/1988 Turner ..... 401/43
4,826,046 A * 5/1989 Rudick ..... 222/129.3
5,215,106 A * 6/1993 Choi ..... 132/109
5,242,085 A * 9/1993 Richter et al. ..... 222/105
5,261,427 A * 11/1993 Dolev ..... 132/200
5,297,882 A * 3/1994 Kornides ..... 401/184
(Continued)

FOREIGN PATENT DOCUMENTS

EP 1018309 A1 7/2000
(Continued)

*Primary Examiner* — Rachel Steitz
(74) *Attorney, Agent, or Firm* — The Farrell Law Firm, P.C.

(57) ABSTRACT

This invention relates to a device for performing dyeing operation such as bleaching, coloring, and coating using an electric power with a dye container attached. Main components of the invention are comprised of a body, a comb assembly, a pump and a piping member. The body composed of handle and head is equipped with a motor, battery and switch. The comb assembly composed of a plurality of teeth having respective conduits is rotatably fixed to the body. The pump is connected to the motor so as to feed the dye from the container attached to the body to the respective comb of the comb assembly with an enforced and uniform flow. The piping member is disposed at a flow path between the pump and the comb assembly so as to maintain a uniform flow of dye through the conduits of the comb assembly.

8 Claims, 24 Drawing Sheets

U.S. PATENT DOCUMENTS

| | | | | |
|---|---|---|---|---|
| 5,615,803 | A * | 4/1997 | Hatakeyama et al. | 222/94 |
| 5,622,192 | A * | 4/1997 | Chiou | 132/112 |
| 5,711,454 | A * | 1/1998 | Kobayashi et al. | 222/95 |
| 5,755,241 | A * | 5/1998 | Cheung | 132/112 |
| 6,012,462 | A * | 1/2000 | Schmittou | 132/113 |
| 6,022,163 | A * | 2/2000 | Asfur | 401/175 |
| 6,357,450 | B1 * | 3/2002 | Paice | 132/114 |
| 6,513,534 | B1 * | 2/2003 | Sofer et al. | 132/112 |
| 6,955,176 | B2 * | 10/2005 | Ackermans et al. | 132/112 |
| 7,044,334 | B2 * | 5/2006 | Mita et al. | 222/94 |
| 2001/0040173 | A1 * | 11/2001 | Yamamoto et al. | 222/106 |

FOREIGN PATENT DOCUMENTS

| | | |
|---|---|---|
| JP | 11-49255 | 2/1999 |
| JP | 12-62862 | 2/2000 |
| KR | 1989-12592 | 9/1989 |
| KR | 2001-51736 | 3/1999 |
| KR | 2001-51735 | 7/1999 |
| KR | 2002-70351 | 10/2001 |

* cited by examiner (a)

(b)

DYE CONTAINER AND HAIR DYEING DEVICE USING THE SAME

TECHNICAL FIELD

The present invention relates to a hair dyeing device, and more particularly to a hair dyeing device which is capable of easily using dyes in dye containers (for example, tubes, bottles, or bags) containing dyeing liquids therein without forcibly extracting the dyeing liquids from the dye containers when hair (for example, hair of the head, fiber, or body hair) is to be dyed (for example, decolored, colored, developed, or coated), which is capable of using dyes in dye containers as much as desired without wasting dyes, which is capable of easily and quickly mixing various dyes (for example, a base dyestuff and a stabilizer, a developer, a decolorizer, or other dyestuffs to be mixed with the base dyestuff) as much as desired, whereby hair is easily and conveniently dyed with new colors. The present invention also relates to a dye container which can be used in such a hair dyeing dev ice.

BACKGROUND ART

Up to now, various hair dyeing devices have been proposed, examples of which are disclosed in the following patents.

1. Korean Utility Model No. 200270351 filed on October 2001 in the name of Esther Cos. Co., Ltd.
2. Korean Utility Model No. 200151735 filed on July 1997 in the name of Dong Sung Pharm. Co., Ltd.
3. Korean Utility Model No. 200151736 filed on March 1997 in the name of Dong Sung Pharm. Co., Ltd.
4. U.S. Pat. No. 6,513,534 filed on October 1999 in the name of Montec Products Development Ltd. (Ill.)
5. U.S. Pat. No. 6,460,546 filed on August 2001 in the name of Montec Products Development Ltd. (Ill.)
6. U.S. Pat. No. 6,457,476 filed on January 2001 in the name of The Procter & Gamble Co.
7. U.S. Pat. No. 6,453,909 filed on March 2000 in the name of L'Oreal S. A. (Paris, FR)
8. U.S. Pat. No. 6,450,366 filed on October 2000 in the name of L'Oreal S. A. (Paris, FR)
9. U.S. Pat. No. 6,431,178 filed on January 2000 in the name of Pentel Kabushiki Kaisha (JP)
10. U.S. Pat. No. 6,390,101 filed on May 2000 in the name of Larry Rush Alexander (Evanston, Ill.)
11. U.S. Pat. No. 6,386,778 filed on January 2001 in the name of The Gillette Company (Boston, Mass.)
12. U.S. Pat. No. 6,357,450 filed on December 2000 in the name of Andrew Paice (GB)
13. U.S. Pat. No. 6,357,449 filed on November 2000 in the name of New Basics, Inc. (Boston, Mass.)
14. U.S. Design Pat. No. D442,331 filed on April 2000 in the name of New Basics, Inc. (Boston, Mass.)
15. U.S. Pat. No. 6,334,727 filed on April 2000 in the name of L'Oreal S. A. (Paris, FR)
16. U.S. Pat. No. 6,334,449 filed on May 2000 in the name of The Procter & Gamble Co.
17. U.S. Pat. No. 6,285,518 filed on August 1999 in the name of Michel Laporte (FR)
18. U.S. Pat. No. 6,260,557 filed on July 2000 in the name of Christine Yarbrough (Fla.)
19. U.S. Pat. No. 6,244,433 filed on February 2000 in the name of L'Oreal S. A. (Paris, FR)
20. U.S. Pat. No. 6,182,822 filed on August 1998 in the name of L'Oreal S. A. (Paris, FR)

21. U.S. Pat. No. 6,176,389 filed on December 1998 in the name of L'Oreal S. A. (Paris, FR)
22. U.S. Pat. No. 6,145,513 filed on February 1999 in the name of New Basics, Inc. (Boston, Mass.)
23. U.S. Pat. No. 6,142,157 filed on February 1999 in the name of L'Oreal S. A. (Paris, FR)
24. U.S. Pat. No. 6,062,230 filed on July 1998 in the name of Zarko Kajgana (Ohio)
25. U.S. Pat. No. 6,053,177 filed on February 1999 in the name of Montec Products Development Ltd. (Ill.)
26. U.S. Pat. No. 6,012,462 filed on April 1999 in the name of Rodney L. Schmittou (Calif.)
27. U.S. Pat. No. 6,009,881 filed on October 1998 in the name of L'Oreal S. A. (Paris, FR)
28. U.S. Pat. No. 5,937,866 filed on April 1998 in the name of Laila Magharehi (Calif.)
29. U.S. Pat. No. 5,913,314 filed on October 1998 in the name of Michelle R. Garrett (MD.)
30. U.S. Pat. No. 5,848,730 filed on December 1998 in the name of Kao Corporation (Tokyo, JP)
31. U.S. Pat. No. 5,778,902 filed on December 1996 in the name of Christine Nagy (N.Y.)
32. U.S. Pat. No. 5,676,480 filed on April 1996 in the name of Nada Tosto (N.Y.)
33. U.S. Pat. No. 5,593,065 filed on January 1997 in the name of Pakmax, Inc. (N.J.)
34. U.S. Pat. No. 5,569,368 filed on June 1995 in the name of Edvin G. Larsky (Va.)
35. U.S. Pat. No. 5,472,456 filed on January 1995 in the name of Edvin G. Larsky (Va.)
36. European Pat. No. 1,018,309 filed on July 2000 in the names of Pentel Kabushiki Kaisha (JP) and Taico Co. (JP)

The above-mentioned conventional hair dyeing devices may be classified into several types of hair dyeing devices, which will be now described.

A first type of hair dyeing device, which is shown in FIG. 1*a*, is a device wherein a predetermined amount of dye (or paste) is taken out of each of dye containers 1, which are not connected to a main body 3 of the hair dyeing device, so that the dyes taken out of the dye containers 1 are mixed, the mixed dyes are filled into a cylinder 2 of the hair dyeing device, which is formed in the shape of a syringe or an airtight container, and a piston is pushed so that the mixed dyes are discharged through holes 4 defined in tines or through holes 4*a* defined between the tines.

A second type of hair dyeing device is a device wherein a predetermined amount of dye is taken out of each of dye containers 1, which are not connected to the hair dyeing device, so that the dyes taken out of the dye containers 1 are mixed, as in the first type of hair dyeing device, the mixed dyes are filled into a collapsible bag, which is pressed so that the mixed dyes are discharged through holes 4 defined in tines or through holes 4*a* defined between the tines.

A third type of hair dyeing device, which is shown in FIG. 1*b*, is a device wherein a predetermined amount of dye is taken out of each of dye containers 1, which are not connected to a main body 6 of the hair dyeing device, so that the dyes taken out of the dye containers 1 are mixed, as in the first or second type of hair dyeing device, the mixed dyes are filled into a cylinder 2 of the hair dyeing device, and the mixed dyes in the cylinder 2 are discharged through holes (not shown) defined in tines by means of a driving unit comprising motor 5, a gear 8, and a cam 9.

In each of the first to third types of hair dyeing devices with the above-stated constructions, a predetermined amount of dye must be taken out of each of the dye containers 1, which are not connected to the main body 3 or 6 the hair dyeing device, the dyes taken out of the dye containers 1 must be mixed by hand or other various means, and then the mixed dyes must be put into the cylinder 2 of the hair dyeing device. The above-mentioned process must be repeatedly carried out when the mixed dyes are insufficient or excessive during a dyeing operation. Furthermore, flow channels formed in the cylinder 2 or the tines may become clogged, but there is provided no means for opening the clogged flow channels. Consequently, hands, the hair dyeing devices, or the environment may be easily contaminated when the dyeing operation is carried out using any of the aforesaid hair dyeing devices.

A fourth type of hair dyeing device is a device wherein a spray can is attached to the outside of the hair dyeing device or attached to a main body of the hair dyeing device in such a manner that the spray can serves as a handle, so that a dye and a developer are sprayed due to the pressure of gas in the spray can. This type of hair dyeing device has advantages in that the hair dyeing device is not equipped with a cylinder and piston unit for discharging the dye and in that there is no necessity for taking out two dyes from the containers, mixing the taken-out dyes, and filling the mixed dyes into the cylinder of the hair dyeing device. However, the fourth type of hair dyeing device also has disadvantages in that the dye is scattered due to being aerosolized, and thus the skin of a user is contaminated, the aerosolized dye gets into the eyes of the user, or the environment is contaminated.

A fifth type of hair dyeing device is a device wherein dye is filled into a pressure container, which is in turn hermetically sealed, so that the dye is discharged through a hose by means of a pressure difference created when an external pressurized air is blown into the pressure container. Although no previous mixing process of dyes is required, the dye must be taken out of a dye container containing the dye and filled into the pressure container, and then the pressure container must be hermitically sealed. Furthermore, air may be introduced into the hose when the pressure container is shaken or tilted. As a result, the dye is dangerously spouted. Consequently, this type of hair dyeing device has disadvantages in that only a watery dye can be used in the hair dyeing device.

Moreover, the dye cannot be uniformly distributed by force through the holes defined in the tines according to the first to fifth types of hair dyeing devices and other conventional hair dyeing devices. Specifically, the dye is distributed to the respective holes through orifices and is then discharged through the holes, or the dye is distributed to the respective orifices and is then discharged through the orifices in all of the conventional hair dyeing devices. However, the dye is discharged through naturally opened holes since the respective dye holes communicate with each other. Consequently, the conventional hair dyeing devices are not capable of uniformly distributing in force the dye. Especially when the flow of the dye is obstructed or the holes are clogged, the dye is applied to the head of a user partially excessively and partially insufficiently since the flow rate of the dye passing through the obstructed holes is quite different from that of the dye passing through the remaining normal hole. As a result, the dye may run down the face of the user or splash.

DISCLOSURE OF THE INVENTION

Therefore, the present invention has been made in view of the above problems, and it is an object of the present invention to provide a hair dyeing device which is capable of easily using dyes in dye containers containing dyeing liquids therein without forcibly extracting the dyeing liquids from the dye containers when hair is to be dyed, which is capable of using dyes in dye containers as much as desired without wasting dyes, which is capable of easily and quickly mixing various dyes as much as desired, whereby hair is easily and conveniently dyed with new colors.

It is another object of the present invention to provide a dye container which can be used in such a hair dyeing device.

In accordance with one aspect of the present invention, the above and other objects can be accomplished by the provision of a dye container for storing a hair dye, comprising: a dye-containing space adapted not to make contact with the air introduced by discharging the dye; the dye-containing space being defined in a thin resin film, the thin resin film being easily collapsible so that a negative pressure applied to the dye-containing space is small when the dye is sucked from the dye container; and at least one mouth adapted so that the dye is discharged through the mouth.

Preferably, the dye container further comprises at least one hole formed at the outside of the dye container adjacent to the dye-containing space so that the negative pressure created by diminution of the dye is reduced.

In accordance with another aspect of the present invention, there is provided a hair dyeing device for discharging dye by means of an electric force to dye hair, comprising: a main body having a motor, a power source, a switch, and a port formed so that at least one dye container as mentioned above is attached to the main body through the port; a comb assembly attached to the main body, the comb assembly comprising a plurality of tines, each of the tines having at least one flow channel formed therein; at least one pump connected to the motor for supplying dye contained in the dye container attached to the main body to the tines of the comb assembly; and flow channels formed so that the dye supplied by the pump flows to the respective tines along the corresponding flow channels.

Preferably, the comb assembly is pivotably attached to one end of the main body.

Preferably, each of the tines of the comb assembly has one to eight flow channels formed therein.

Preferably, the pump mounted in the main body is a multi channel pump having a plurality of pumping elements divided by partitions, the pumping elements being coaxially arranged, and wherein the number of the pumping elements corresponds to that of the tines.

Preferably, the hair dyeing device further comprises a valve mounted in each of the flow channels formed between the pump and the comb assembly so that the dye is discharged through each of the flow channels while the dye is mixed with another dye or the dye is discharged through each of the flow channels while the dye is not mixed with another dye depending upon selected positions of the valve.

Preferably, the hair dyeing device further comprises an intermediate plate attached to the port formed in the main body so that the dye container is easily replaced irrespective of the size of a mouth of the dye container.

Preferably, the hair dyeing device further comprises a plurality of dispensers disposed between the pump and the comb assembly for uniformly distributing the dye supplied by the pump, wherein each of the dispensers has a plurality of rotors arranged on the same shaft.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

The present invention relates to a dye container and a hair dyeing device using the same. The general constructions of the dye container and the hair dyeing device will be first described with reference to FIGS. 2 to 4, and then the dye container will be described in detail with reference to FIG. 5.

Figure 1:
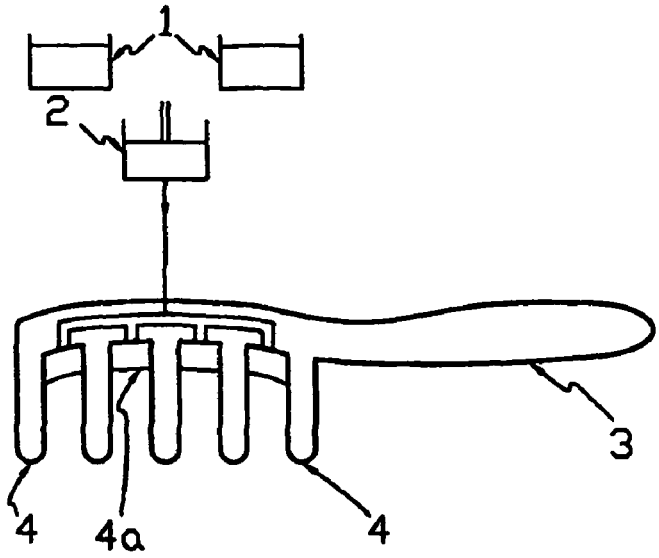
FIGS. 1*a* and 1*b* are schematic views showing conventional hair dyeing devices, respectively.
Figure 1:
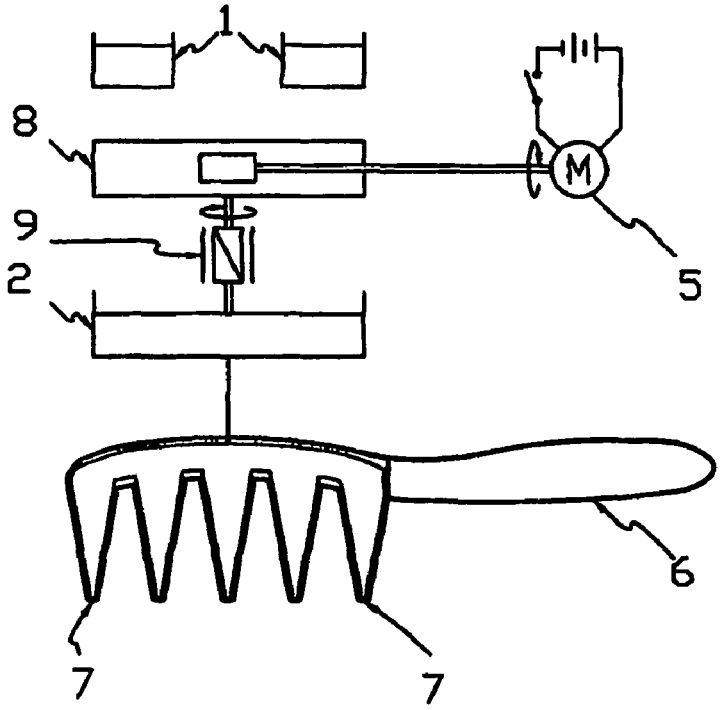
Figure 2:
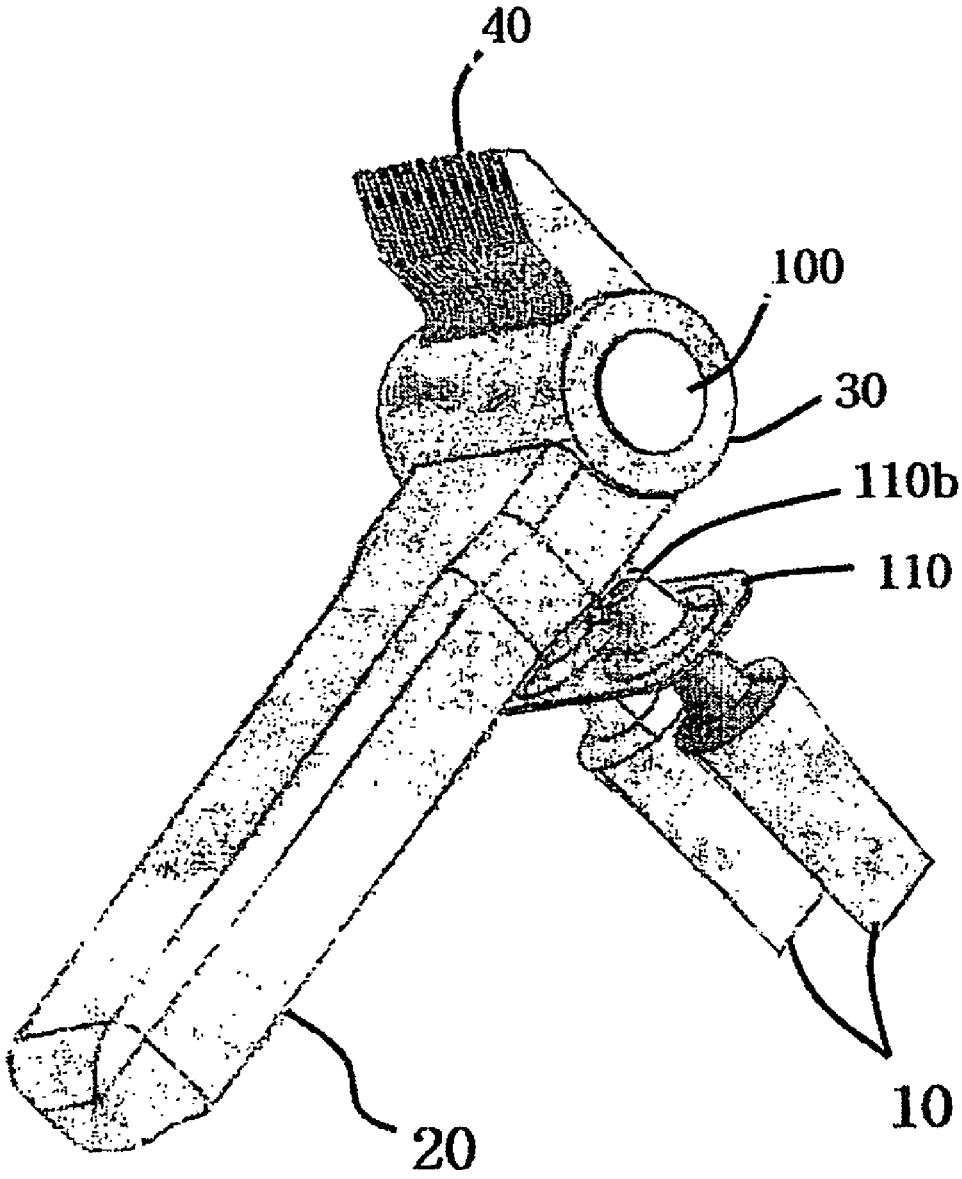
FIG. 2 is a perspective view of a hair dyeing device according to a first preferred embodiment of the present invention.
Figure 3:
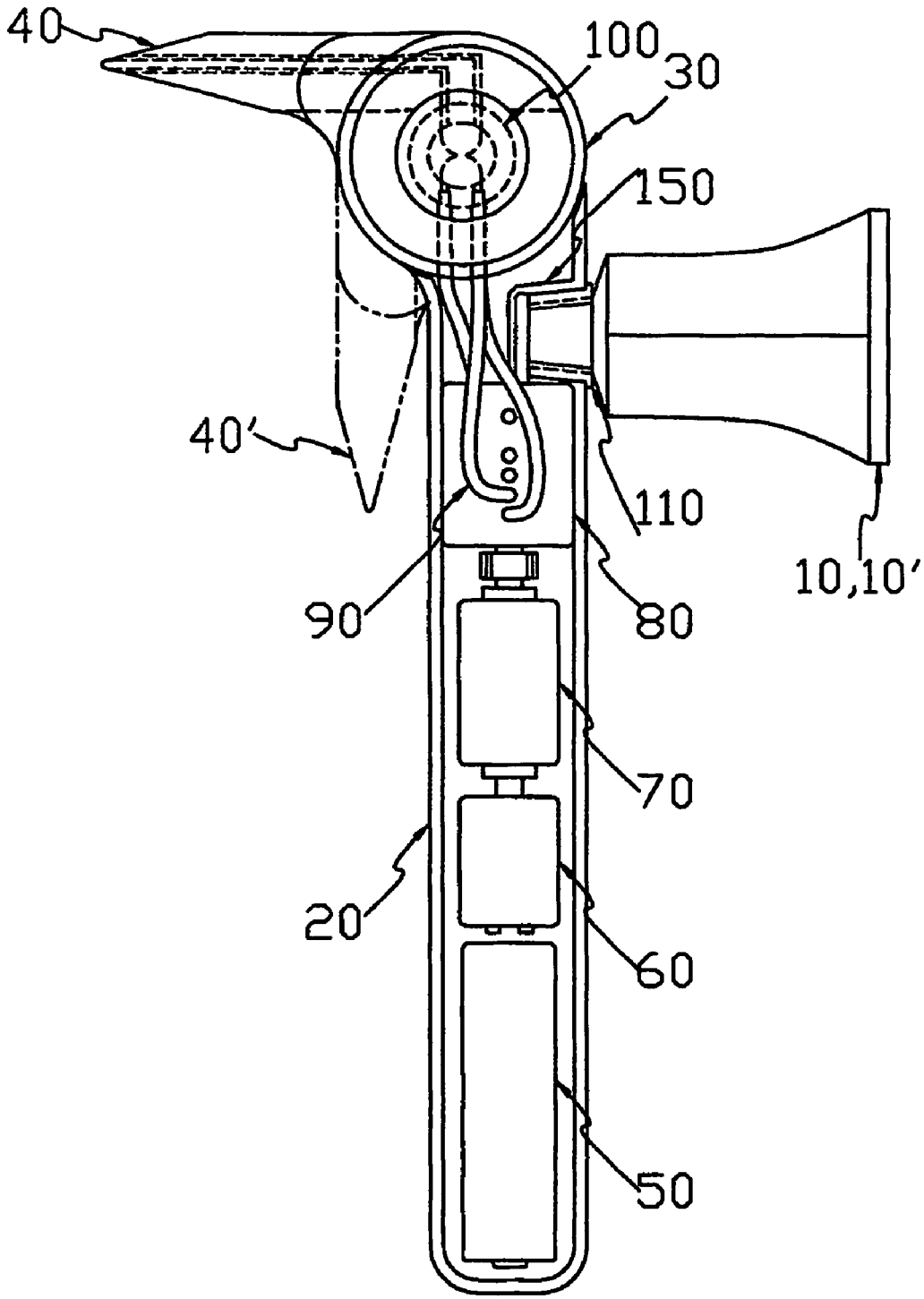
FIG. 3 is a side view, partially cut away, of the hair dyeing device of FIG. 2 showing the interior of the hair dyeing device.
Figure 4:
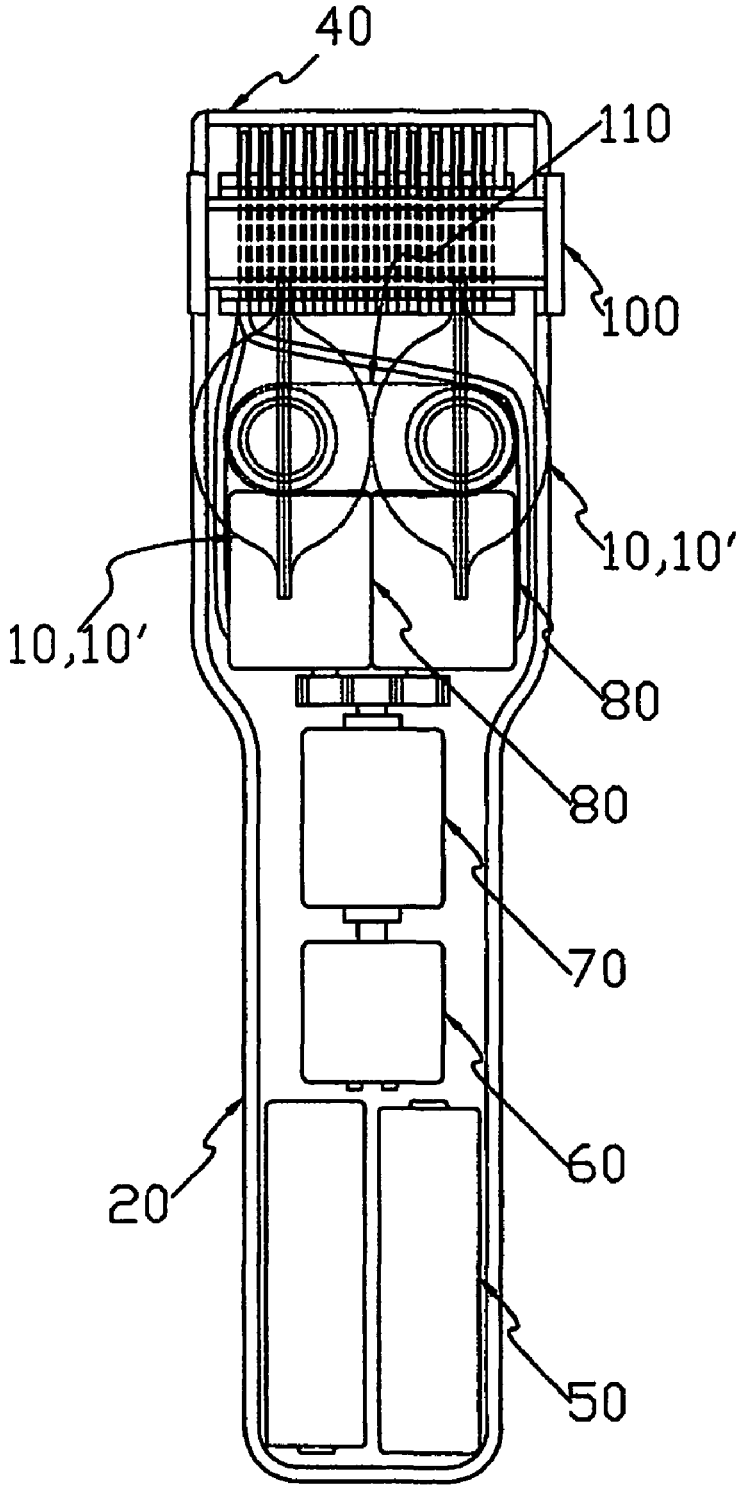
FIG. 4 is a plan view, partially cut away, of the hair dyeing device of FIG. 2 showing the interior of the hair dyeing device.

Referring to FIGS. 2 to 4, the hair dyeing device according to a first preferred embodiment of the present invention comprises a main body 20, a head unit 30, and a comb assembly 40. The main body 20 serves as a handle.

Dye containers 10 for containing dye are detachably attached to ports 150, which are formed in the main body 20 or the head unit 30 so that the dye containers 10 can be easily attached to or detached from the ports 150.

The head unit 30 is coupled with the comb assembly 40. Also, the head unit 30 is hinged to the main body 20 of the hair dyeing device in a similar fashion to a hair drier.

Figure 5:
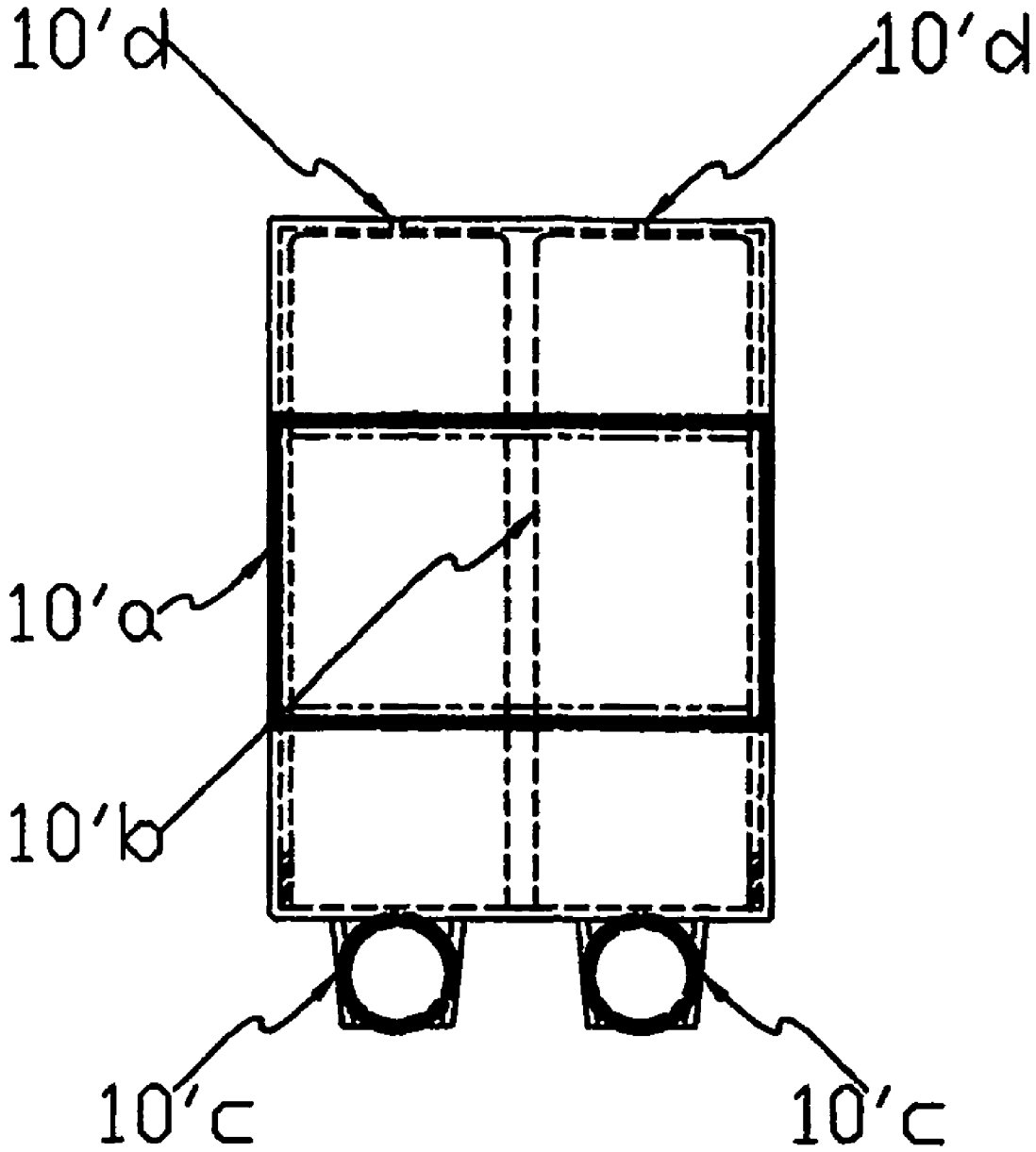
FIG. 5 is a view showing a dye container of the present invention.

Various kinds of containers having different capacities may be used as the dye containers 10 according to the use thereof, for example, depending upon whether they are disposable or rechargeable. Preferably, the dye containers 10 each formed in the shape of a tube of toothpaste as shown in FIG. 2 may be conveniently used. Alternatively, cartridge-type dye containers 10' as shown in FIG. 5 may be also advantageously used in that the dye containers 10' can be repeatedly reused. Whichever containers 10 or 10' are used, it is most preferable that the respective containers 10 or 10' have structures wherein the dyes do not make contact with air when the dye is diminished so that degeneration of the dyes caused by contact of the dyes with the air is prevented.

The tube-type dye containers 10 prevent introduction of air into the dye containers while the dyes are discharged.

In the hair dyeing device of the present invention, the dyes are sucked from the dye containers by using a pump. Consequently, no external force is applied to the tube-type dye containers 10 as compared to the case that the tube-type dye containers are pressed by hands to extract the dyes from the tube-type dye containers. For this reason, each of the tube-type dye containers 10 may be made of a soft synthetic resin and manufactured with as small a thickness as possible so that little negative pressure is applied to the interior of each of the dye containers 10 or no negative pressure is applied to the interior of each of the dye containers 10.

Each of the cartridge-type dye containers 10' as shown in FIG. 5 preferably comprises: a casing 10'*a*, made of a hard synthetic resin, having mouths 10'*c;* and thin bags 10'*b* disposed in the casing 10'*a*. The casing 10'*a* has holes 10'*d* formed therethrough. In the cartridge-type dye containers 10', the thin bags 10'*b* are flexibly contracted when the dyes filled in the thin bags 10'*b* are pumping out, whereby contact of the dyes and the air is prevented while the resistance of the thin bags 10'*b* is reduced.

As shown in FIG. 3, in the interior of the main body 20 of the hair dyeing device are mounted a power source 50, a motor 60, and a pump 80. On the exterior of the main body 20 of the hair dyeing device is mounted a switch (not shown) for regulating the power applied to the motor 60. As the pump 80 may be used a vane pump for easily controlling a discharge amount of the dye by means of the motor 60, although a positive-displacement pump, such as a gear pump or a rotary pump, may be used depending upon the characteristics of the dyes. Preferably, a pump with a small capacity, for example, 5-30 cc/min is selected. A reduction gear 70 may be provided depending upon the kind of the motor 60. The comb assembly 40 can be rotated to the position indicated by numerical number 40' so that the angle of the comb assembly 40 can be easily adjusted when the hair dyeing device is in use or stored.

Figure 6:
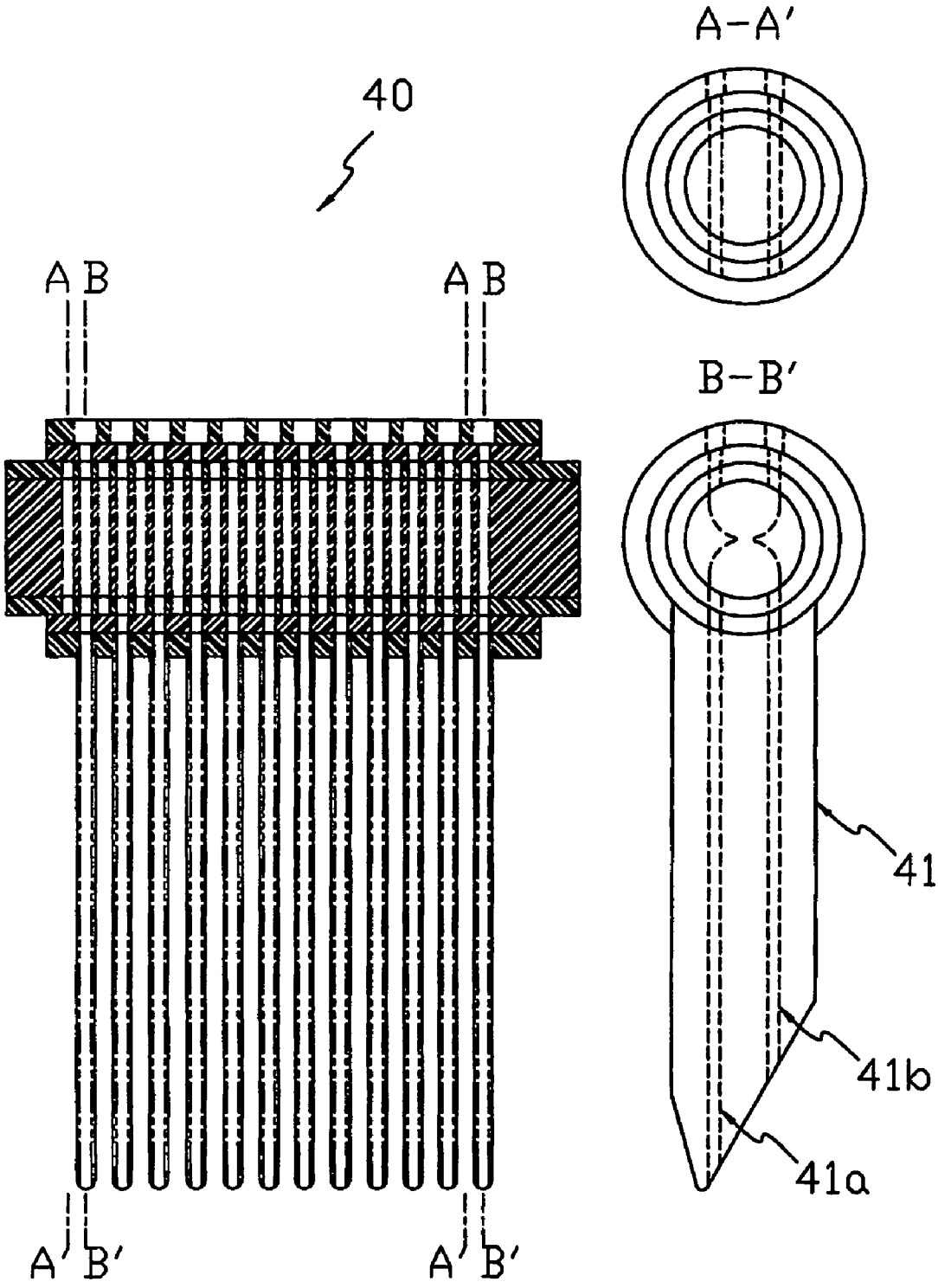
FIG. 6 is a sectional view of a comb assembly of the hair dyeing device of FIG. 2 showing the mixing operation of the comb assembly.
Figure 7:
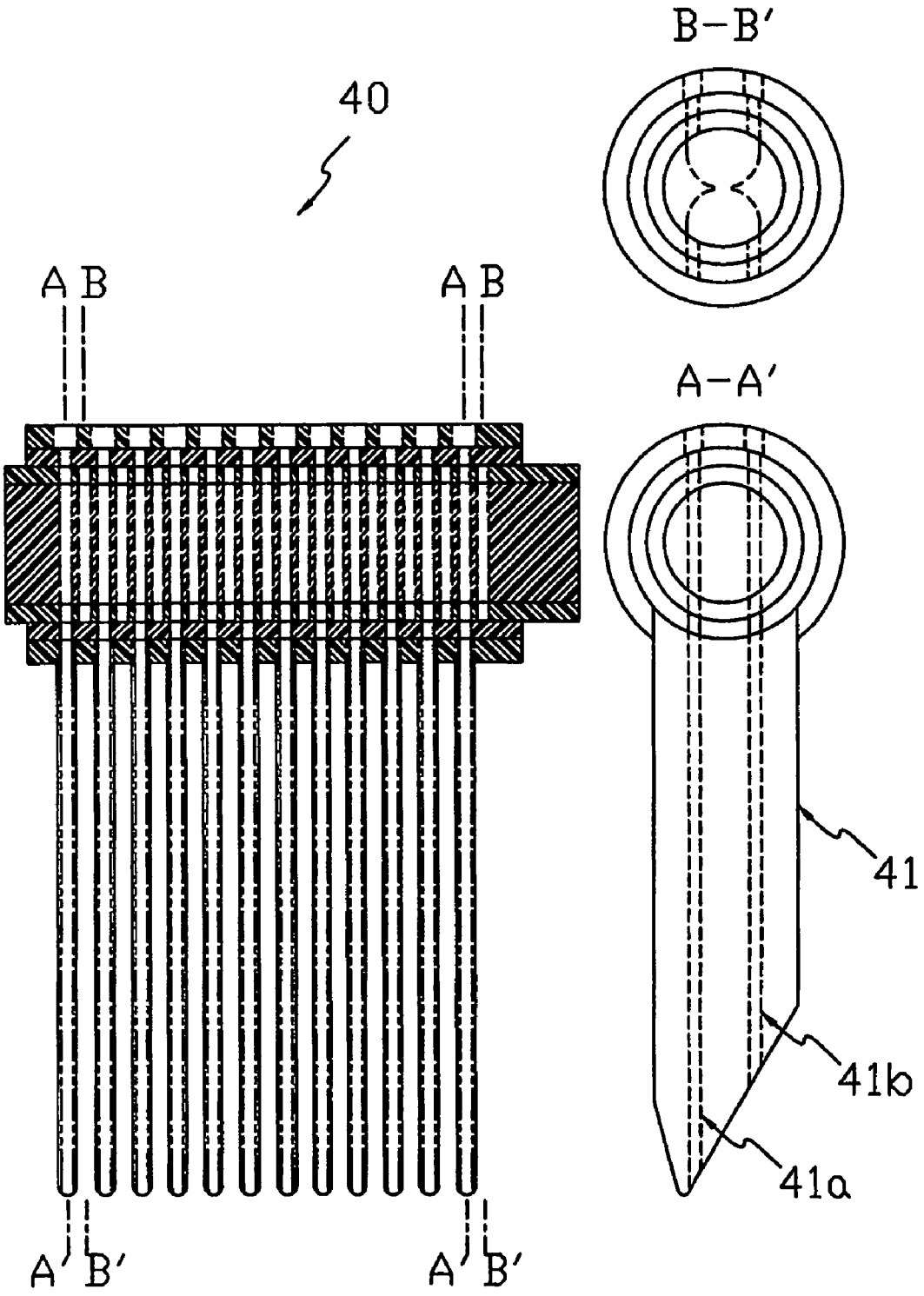
FIG. 7 is a sectional view of a comb assembly of the hair dyeing device of FIG. 2 showing the separating operation of the comb assembly.

As shown in FIGS. 6 and 7, the comb assembly 40 includes a plurality of tines 41, each of which is made of a plate-shaped member with wider width than the conventional comb. Each of the tines 41 has inner flow channels 41*a* and 41*b* longitudinally formed therethrough. The tines 41 are preferably arranged on the basis of the section of each of the tines 41. Specifically, when each of the tines 41 is formed in the shape of a thin and wide plate-shaped member, the tines 41 may be arranged in one or two rows so that the comb assembly has two combing directions when the hair of the user is combed. When each of the tines 41 is formed in the shape of a thin and round member, the tines 41 may be arranged in several rows and columns, like a brush, so that the comb assembly has no combing direction when the hair of the user is combed. When the width of each of the tines 41 is large, the number and the shape of the inner flow channels 41*a* and 41*b* are easily changed. Furthermore, it is advantageous to prevent deformation, damage, and wear caused by friction between the tines 41 and the hair during the dyeing process. The flow channels 41*a* and 41*b* may be completely separated from each other. Alternatively, the flow channels 41*a* and 41*b* may be connected to each other at the upper parts, the middle parts, or the lower parts of the flow channels 41*a* and 41*b*, by which dyeing patterns are changed. As shown in FIG. 7, the lower end of each of the tines 41 is pointed so that the combing operation is successfully carried out, and the lower ends of the flow channels 41*a* and 41*b* are exposed.

Each of the tines 41 of the comb assembly 40 has one to eight flow channels 41*a* and 41*b* formed therein. The number of the flow channels 41*a* and 41*b* preferably corresponds to that of the dyes so that not only the dyes are properly mixed but also the dyes are properly separated or the holes through which the dyes have passed are properly washed.

Each of the tines 41 may be manufactured by means of extrusion molding or deformation processing of a metal sheet when the lengths of the tines 41 are large. On the other hand, each of the tines 41 may be manufactured by means of injection molding when the lengths of the tines 41 are small.

As the pump 80 of the present invention may be preferably used a dual (double) pump or a multi mump having pump units, the number of which corresponds to that of the dyes to be supplied. The pump 80 has an inlet 81*a* and a plurality of outlets 81*b* so that a plurality of dyes are uniformly distributed by force. In other words, a multi channel system is most preferable in which pumping elements 83 (FIG. 11), the number of which corresponds to that of the tines 41 each having the flow channels 41*a* and 41*b* formed therethrough, are coaxially connected so that the pumping elements 83 are synchronized.

Figure 11:
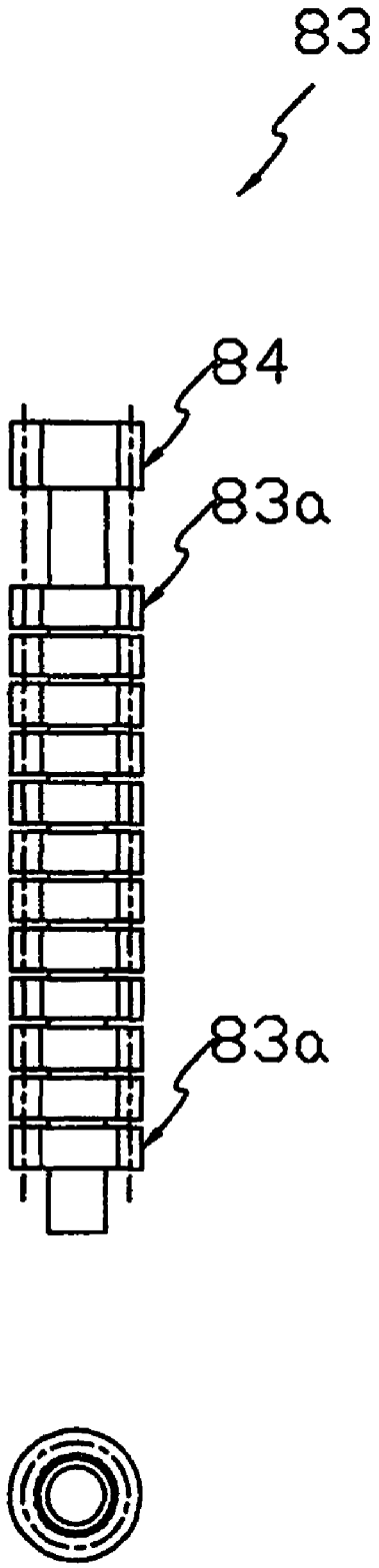
FIG. 11 is a projection view showing a rotor of the multi channel pump of FIG. 8.
Figure 12:
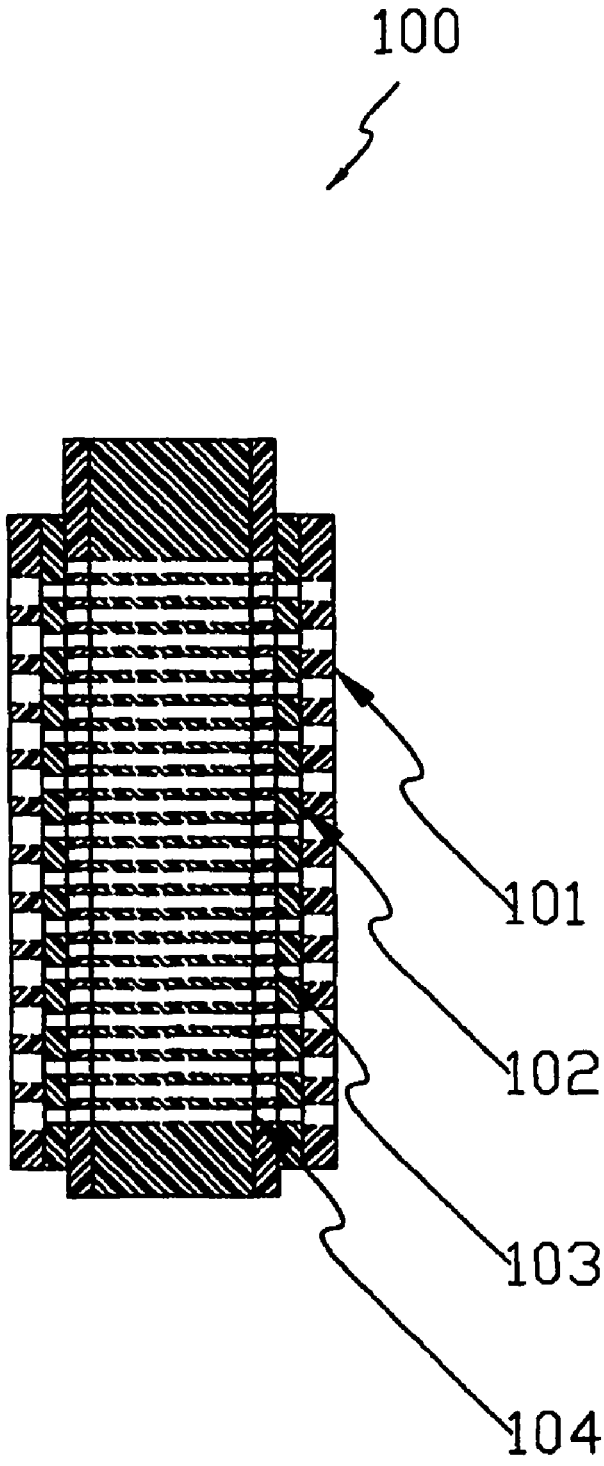
FIG. 12 is an assembled sectional view showing a valve of the hair dyeing device of FIG. 2.
Figure 13:
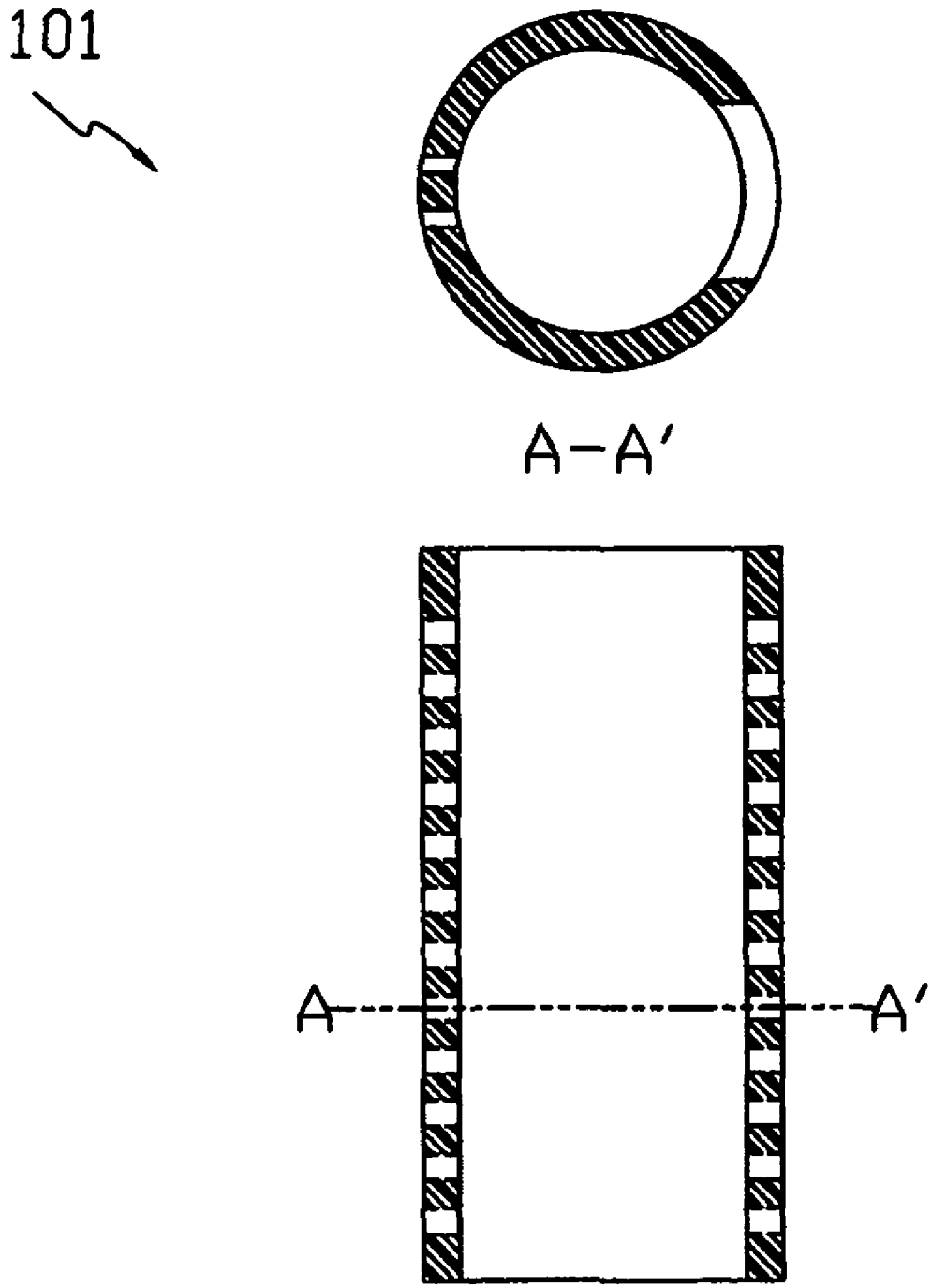
FIG. 13 is a sectional view showing an outer casing, to which the comb assembly is attached, of the valve of FIG. 12.
Figure 14:
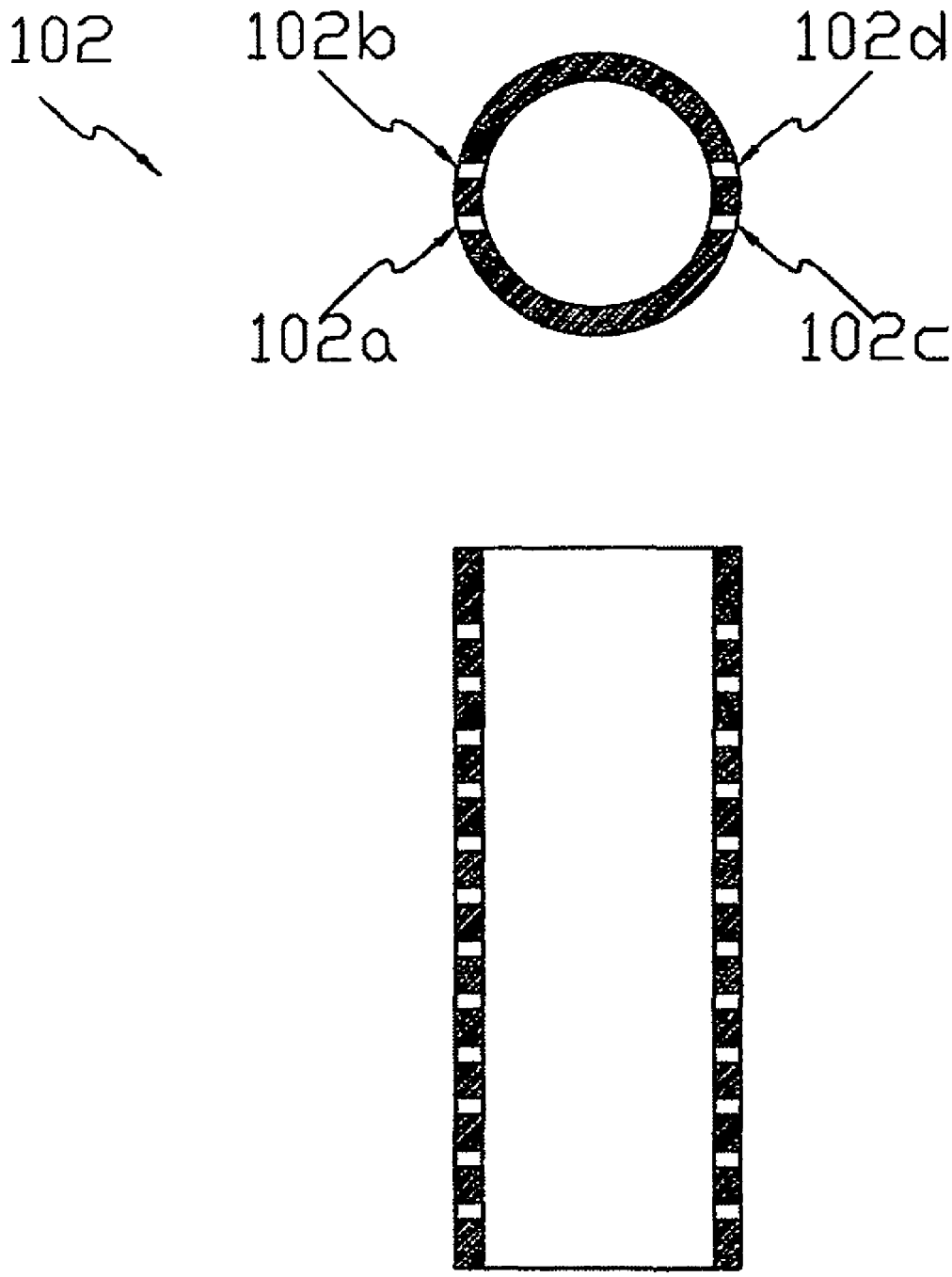
FIG. 14 is a sectional view showing an inner casing, to which the comb assembly is attached, of the valve of FIG. 12.
Figure 15:
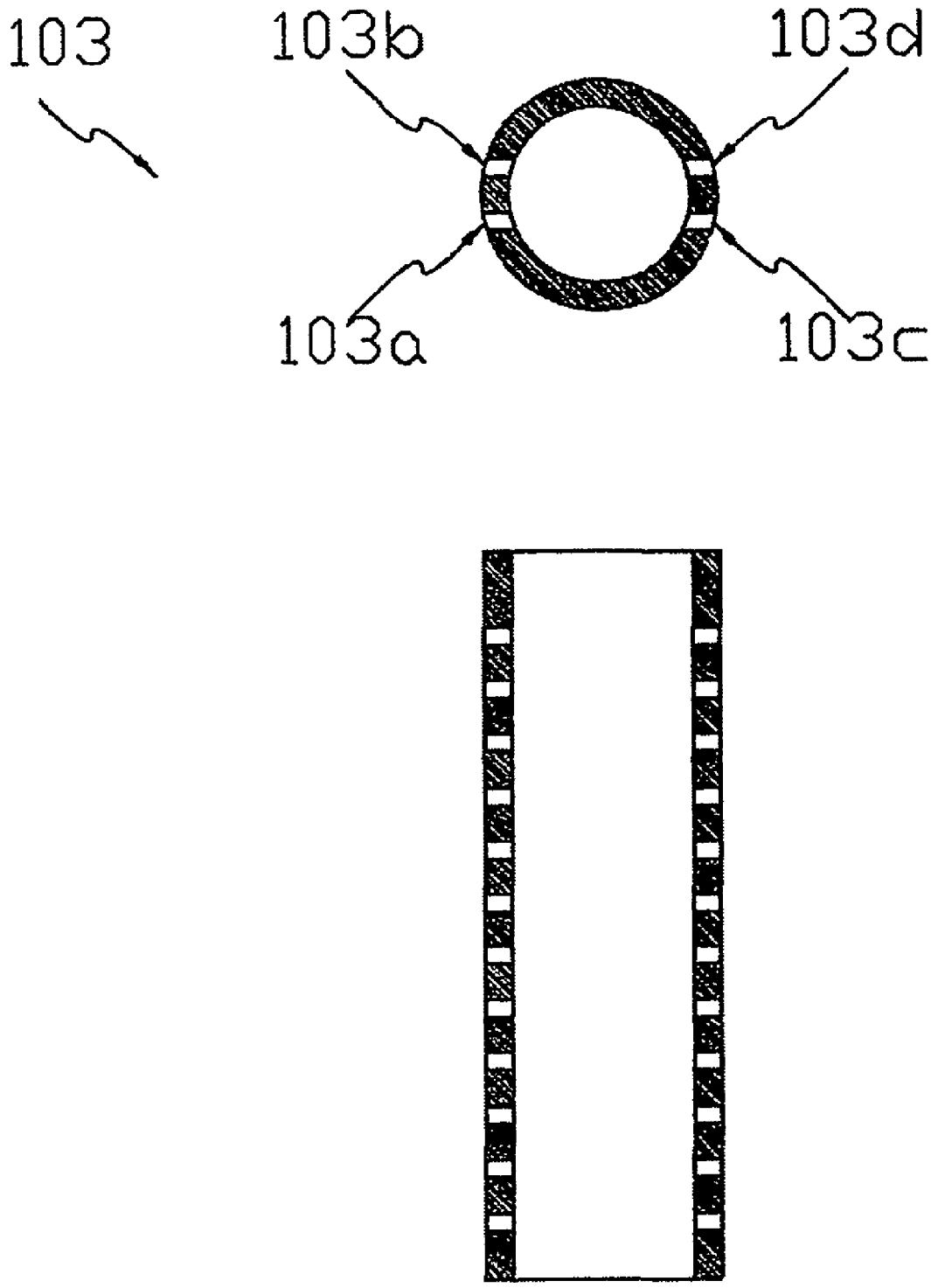
FIG. 15 is a sectional view showing a valve casing of the valve of FIG. 12.
Figure 16:
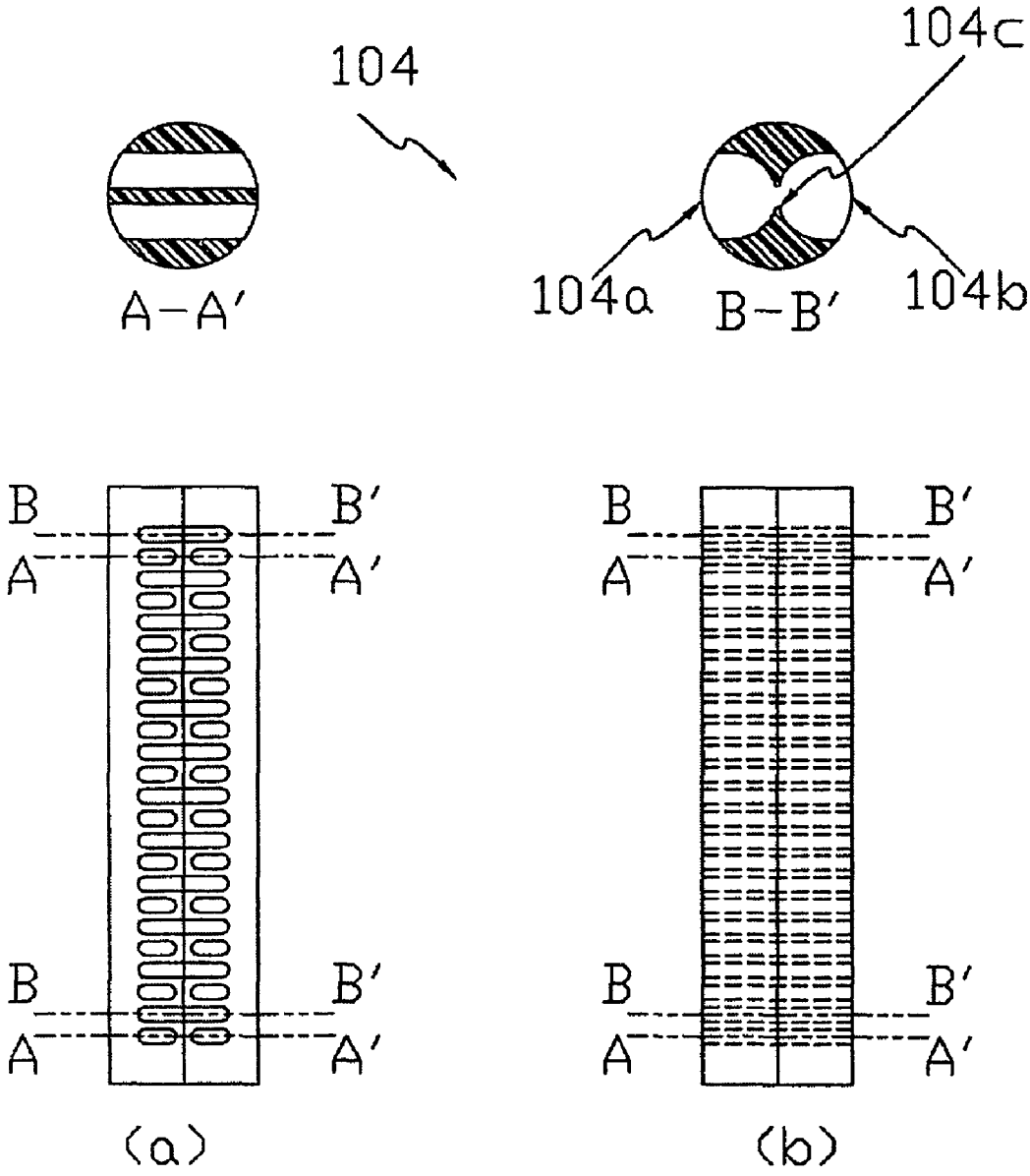
FIGS. 16*a* and 16*b* are projection views respectively showing the valve of FIG. 12.

Referring to FIGS. 8 to 11, the pump 80 comprises an outer casing 81 (FIG. 9), an inner casing 82 (FIG. 10), and pumping elements 83 (FIG. 11). The total discharge amount of the pumping elements 83 equals the discharge amount of the pump 80 of the hair dyeing device.

The inner casing 82 is disposed in the outer casing 81. The outer casing 81 is provided at the upper part thereof with an inlet 81*a* corresponding to an inlet 82*a* of the inner casing 82. The outer casing 81 is provided at the lower part thereof with a plurality of outlets 81*b* corresponding to outlets 82*b* of the inner casing 82.

The inner casing 82 comprises an upper casing part 82*u* and a lower casing part 821. The upper casing part 82*u* is engaged with the lower casing part 821. The inlet 82*a* is provided at the upper part of the inner casing 82, and the outlets 82*b* are provided at the lower part of the inner casing 82. The interior space of the inner casing 82 comprising the upper casing part 82*u* and the lower casing part 821 is composed of a plurality of chambers 82*d* divided from each other by partitions 82*c*. Chambers each having a separated partition may be coaxially arranged or chambers may be arranged in such a manner that the neighboring chambers have a common partition to coaxially integrate all of the chambers.

Each of the pumping elements 83 comprises a plurality of rotors 83*a* arranged on the same shaft. Each of the pumping elements 83 is provided at one end thereof with a coupling 84 for connecting with the motor 60 or the reduction gear 70.

Figure 8:
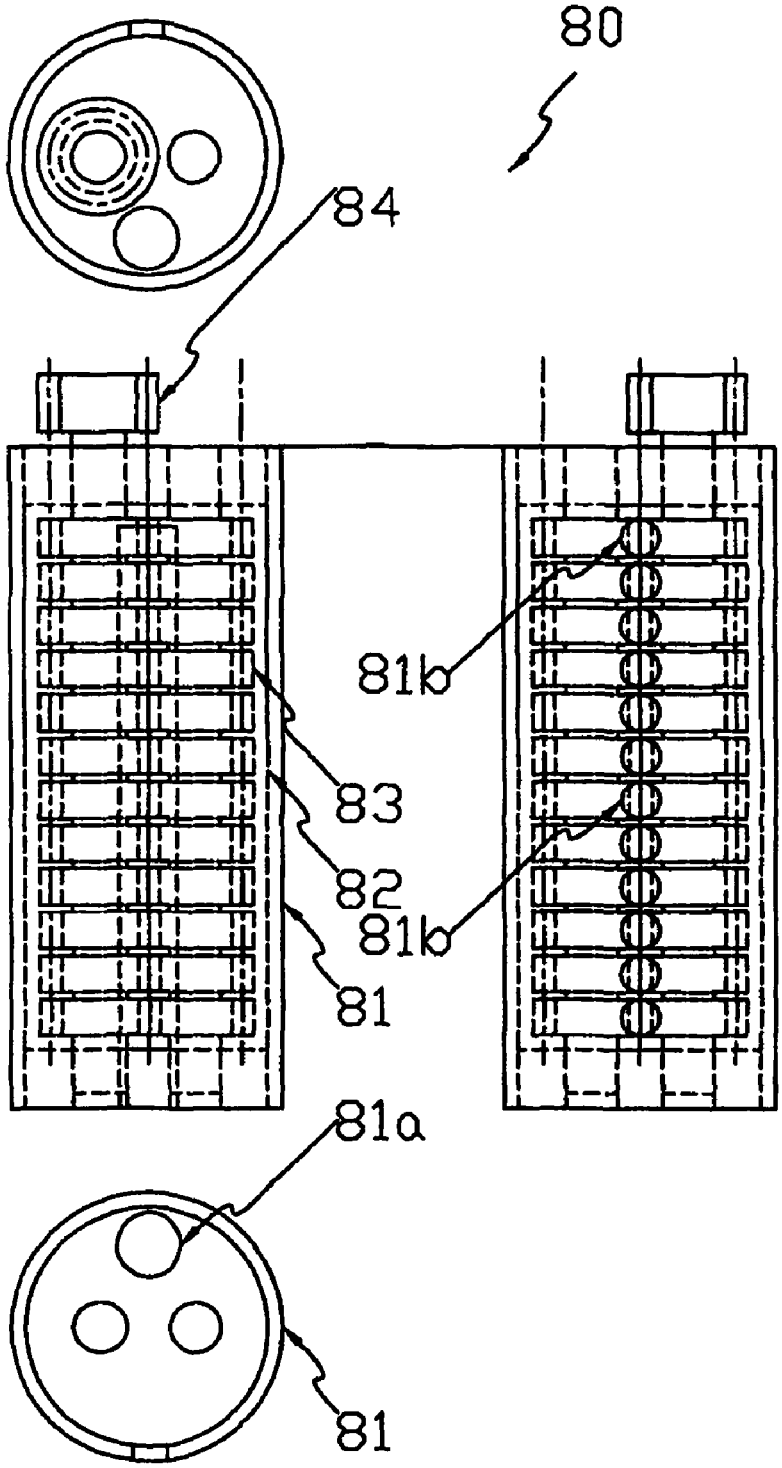
FIG. 8 is a view showing a multi channel pump of the hair dyeing device of FIG. 2.
Figure 9:
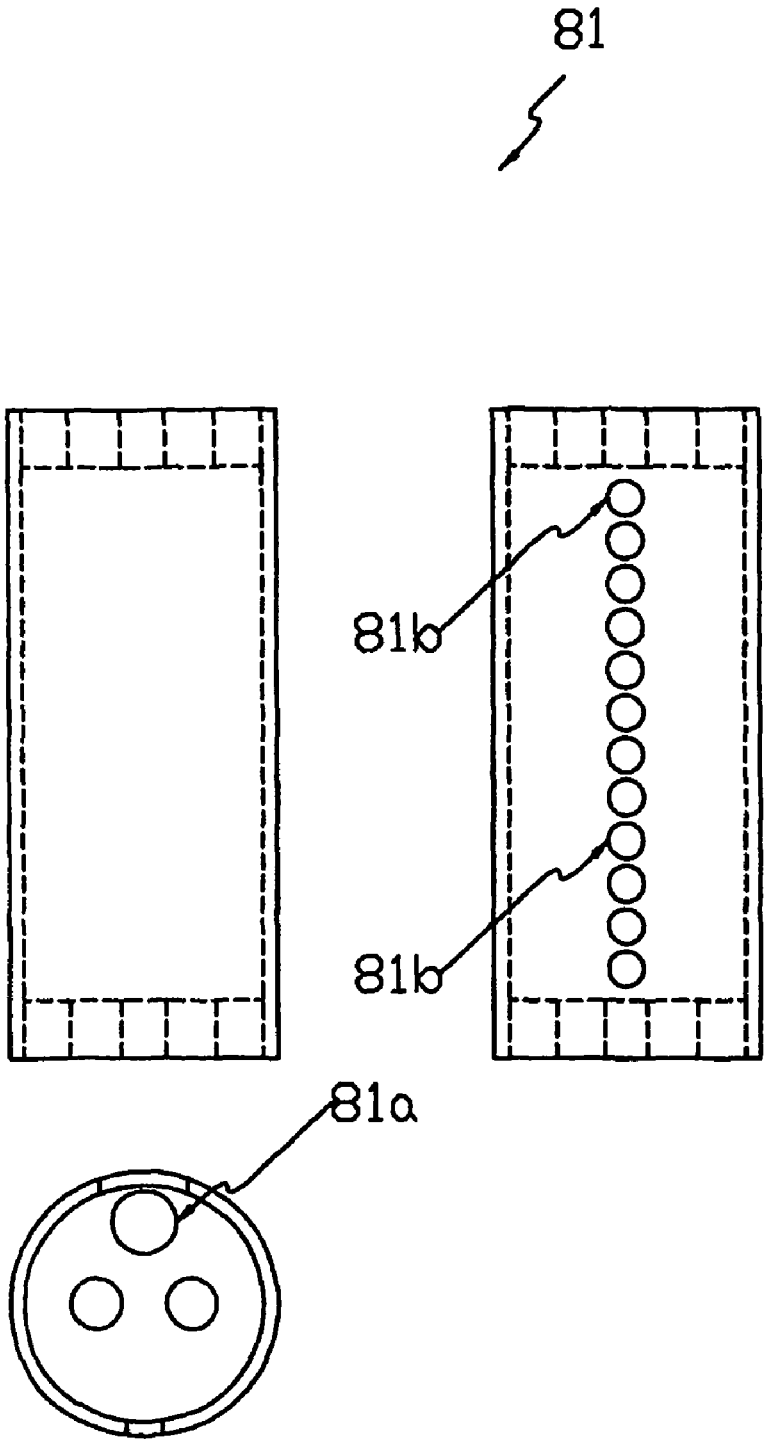
FIG. 9 is a projection view showing an outer casing of the multi channel pump of FIG. 8.
Figure 10:
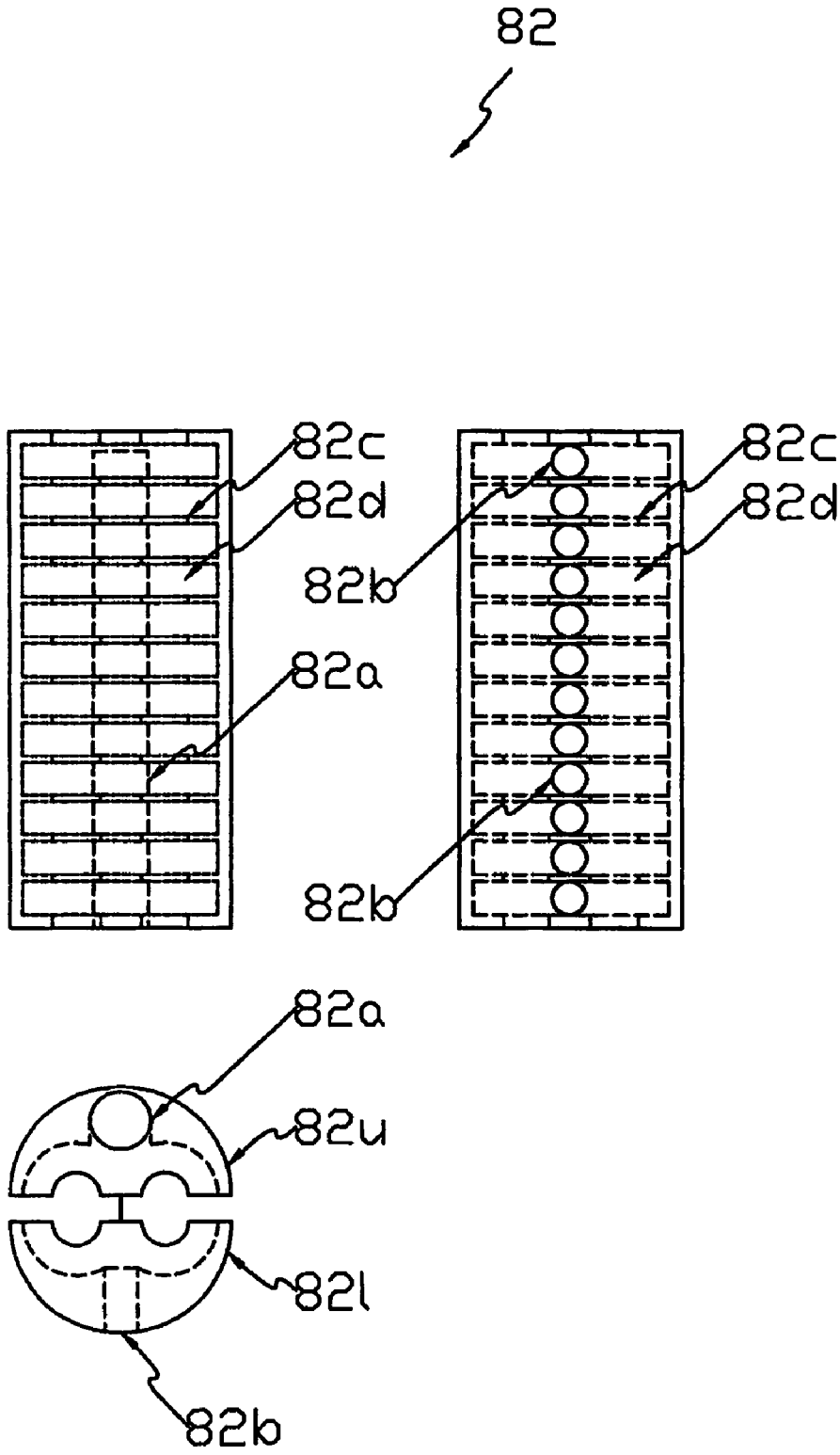
FIG. 10 is a projection view showing an inner casing of the multi channel pump of FIG. 8.

An external gear pump, an internal gear pump, a trochoid pump, a rotary pump, a plunger pump, a squeeze pump, a peristaltic pump, a diaphragm pump, a vane pump, or any other pumps may be applied to the basic mechanism of the pump 80 of the present invention. When the design of the multi channel pump is considered, however, the gear pump or the rotary pump, which is the positive-displacement pump, is preferably used. The pump 80 shown in FIG. 8 is the external gear pump.

The main body 20 or the head unit 30 of the hair dyeing device of the present invention has the ports 150 formed therein, in which the dye containers 10 or 10' are mounted. It is preferable to standardize the ports in manufacturing the main body of the hair dyeing device. Various dye containers with different sizes may be attached to the main body 20 or the head unit 30 of the hair dyeing device by disposing an intermediate plate 110, which will be described later, between the dye containers and the main body or the head unit of the hair dyeing device.

Also, the hair dyeing device of the present invention comprises flow channels 90 through which the dyes are supplied to the respective tines 41 of the comb assembly 40 by means of the pump 80. It is preferable that the inner diameter of each of the flow channels 90 for supplying to the tines 41 of the comb assembly the dyes delivered by the pump 80 in such a manner that the dyes are uniformly distributed by force is larger than that of the each of the flow channels 41*a* and 41*b* of the tines 41, and sections of flow channels through which the dyes are supplied from the dye containers 10 or 10' to the pump 80 are larger than the sum of the inner diameters of the flow channels 90 though which the dyes are supplied to the tines 41 by means of the pump 80, whereby flow resistance and choke effect are reduced. The flow channels 90 are preferably made of flexible materials, for example, flexible hoses, so that they are not damaged when the comb assembly 40 is folded or unfolded.

As shown in FIGS. 12 to 16, the hair dyeing device of the present invention may comprise a valve 100 mounted in the main body 20 of the hair dyeing device for controlling the flow of the dyes. Also, the hair dyeing device of the present invention may further comprise another valve 100 mounted in the head unit 30 of the hair dyeing device for controlling the flow of the dye. The valve 100 mounted in the head unit 30 for selecting a mixing position B-B' and a separating position A-A' is shown in FIGS. 2 to 4.

It is most preferable that the valve 100 is capable of selecting mixing-isolating-separating positions. It is also possible, however, that desired positions are selectively chosen from among the mixing-isolating-separating positions, and then the chosen positions are combined. The combination of the chosen positions results in the provision of a 4 ports-2 positions valve or a 4 ports-3 positions valve. The most preferable combination is a 4 ports 102*a*, 102*b*, 102*c* and 102*d* (FIG. 14)—2 positions A-A' and B-B' valve that is capable of selecting the mixing position B-B' and the separating position A-A'. An example of the dye mixing position B-B' of the 4 ports-2 positions valve is shown in FIG. 6 while an example of the dye separating position A-A' of the 4 ports-2 positions valve is shown in FIG. 7.

Preferably, the mixing valve has a neck part 104*c* disposed between a first chamber 104*a* and a second chamber 104*b* so that the dyes are easily stirred and mixed. Means for operating the mixing-isolating-separating valves comprises a lever or cam (not shown).

Figure 17:
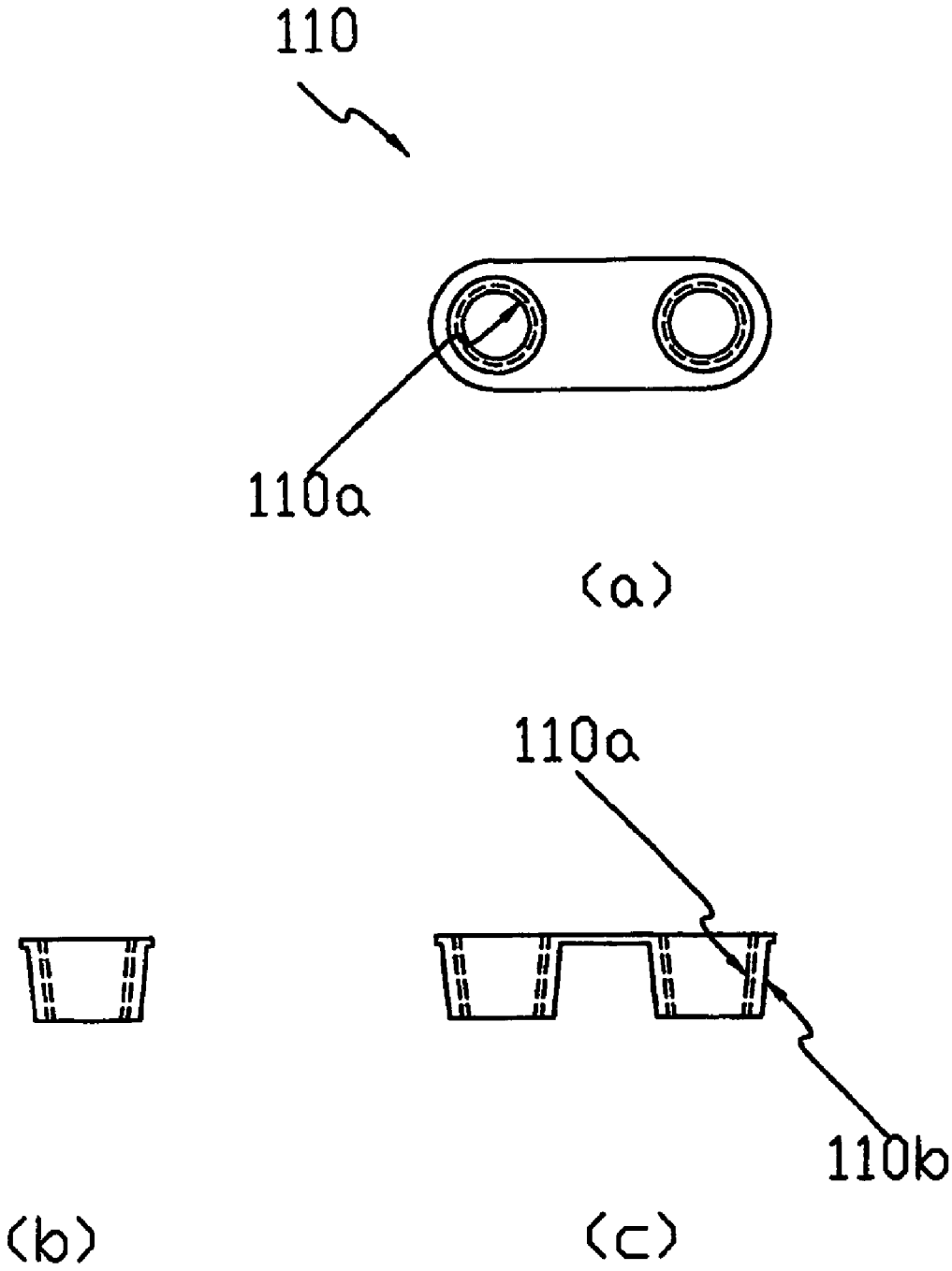
FIGS. 17*a* to 17*c* are projection views respectively showing an intermediate plate of the present invention.

As described above, the ports 150, through which the dye containers 10 or 10' are detachably attached to the main body 20 or the head unit 30 of the hair dyeing device of the present invention, is formed in the main body 20 or the head unit 30 of the hair dyeing device, and the intermediate plate 110 (FIG. 17) is disposed between the ports 150 and the dye containers 10 or 10' so that a user can choose his/her desired dye containers among various dye containers and then attached the chosen dye containers to the intermediate plate 110.

The intermediate plate 110 (FIG. 17) has dye container attachment parts 110*a*, each of which corresponds to the mouth (not shown) of each of the dye containers 10 in terms of shape and size, and main body attachment parts 110*b*, which correspond to the ports 150 formed in the main body 20 or the head unit 30 of the hair dyeing device in terms of shape and size, respectively. Consequently, it is possible to easily change the dye containers by simply replacing the intermediate plate 110.

The ports 150 are formed in the main body 20 or the head unit 30 of the hair dyeing device. Each of the ports 150 has an inner thread part formed in the inner surface thereof so that the dye containers 10 or 10' can be securely engaged in the ports, respectively. Alternatively, each of the ports 150 may be formed in the shape of a truncated cone so that the dye containers 10 or 10' can be more easily engaged in the ports, respectively. Preferably, the dye containers 10 or 10' are easily engaged in or disengaged from the above-mentioned threaded or conical ports 150 while the airtightness of each of the dye containers 10 or 10' is ensured.

Figure 18:
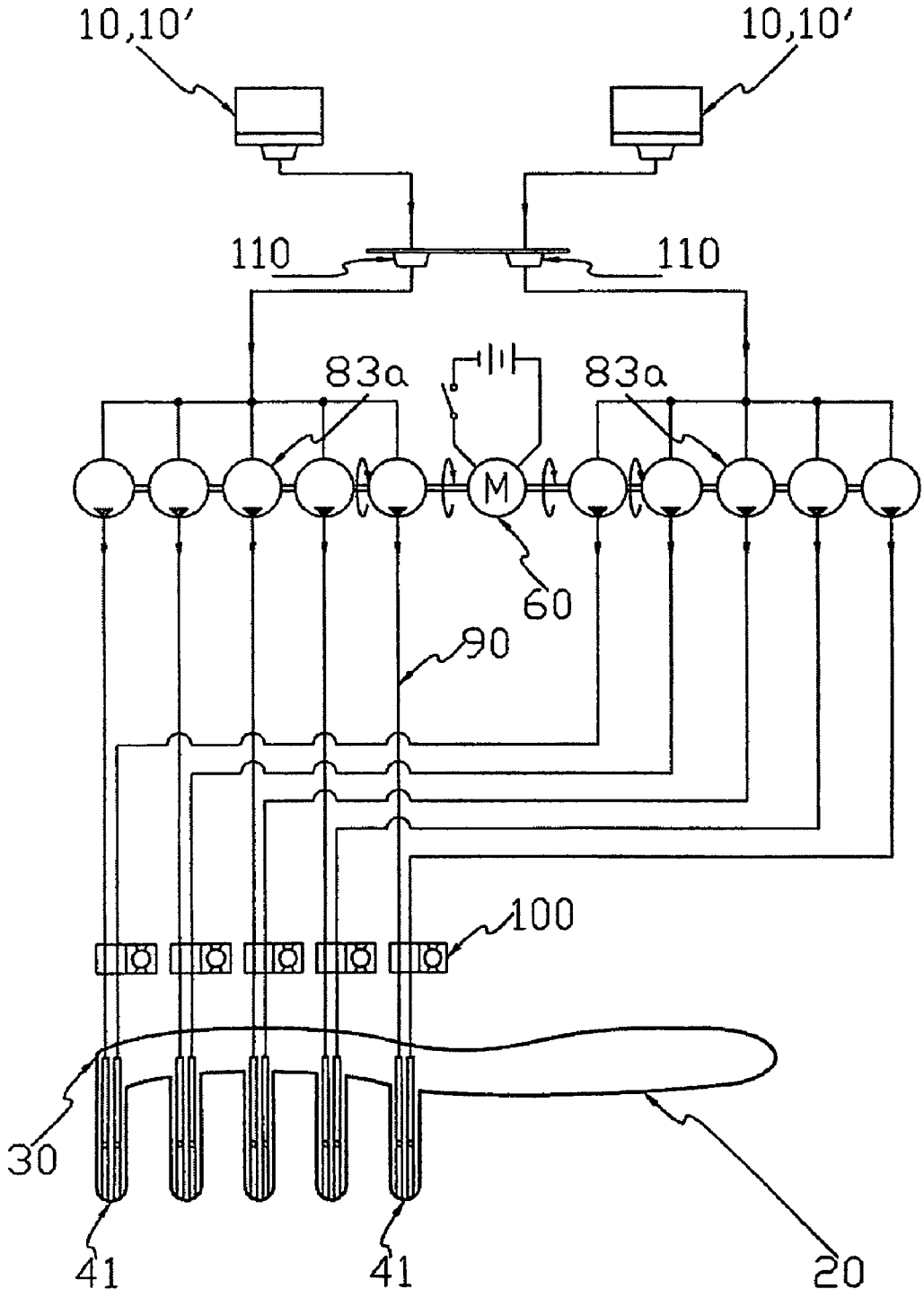
FIG. 18 is a hydraulic circuit diagram of the hair dyeing device according to the first preferred embodiment of the present invention.

FIG. 18 shows controlling the hair dyeing device of the present invention to discharge a mixture of two dyes or separately discharge two dyes through flow channels 41*a* and 41*b* of tines 41 of the comb assembly 40. As shown in FIG. 18, two pumps 80 are connected to a single motor 60 so that the pumps 80 are synchronously driven, and dyes in two dye containers 10 or 10' are discharged by the pumps 80, respectively. On the main body 20 of the hair dyeing device is mounted a switch (not shown) for switching on/off the motor 60. The valves 100 of the hair dyeing device are disposed in such a manner that the flow channels 41*a* and 41*b* of the tines 41 communicate with each other, are separated from each other, or are opened/closed at the same time. Consequently, the mixed or separated dyes are uniformly discharged through all of the flow channels of the tines 41 of the comb assembly 40 when the position A-A' or B-B' of each of the valves 100 is selected and then the motor 60 is operated.

It is preferable for safety reasons that the discharge speed of the dyes, in which the dyes supplied along the flow channels 90 are discharged out of the tines 41 of the comb assembly 40, is not more than 30 mm/sec. It is preferable that a section of each of the flow channels 90 is determined on the basis of the number of the tines 41 and the number of the flow channels 41*a* and 41*b* formed in each tines 41 considering that the volume of a dose of the dye is approximately 120 ml.

FIGS. 19 to 24 show a hair dyeing device according to a second preferred embodiment of the present invention.

According to this embodiment, a plurality of dispensers 140 are mounted in a head unit 30', with which a comb assembly 40 is coupled.

To the head unit 30', with which the comb assembly 40 is coupled, is attached a main body 20 as in the first preferred embodiment described with reference to FIG. 2. The head unit 30' is pivotably attached to the main body 20 of the hair dyeing device by means of a hinge 120. The hair dyeing device according to the second preferred embodiment of the present invention is similar to the hair dyeing device according to the first preferred embodiment of the present invention in that a power source 50, a motor 60, and a pump 80 are mounted in the interior of the main body 20 of the hair dyeing device, and in that the comb assembly 40 comprises a plurality of tines 41. The hair dyeing device according to the second preferred embodiment of the present invention is different from the hair dyeing device according to the first preferred embodiment of the present invention in that the dispensers 140 are mounted in the head unit 30' of the hair dyeing device according to the second preferred embodiment of the present invention.

As shown in FIGS. 20 to 23, each of the dispensers 140 comprises an outer casing 111, an inner casing comprising an upper casing part 112*u* and a lower casing part 112*l*, and pumping elements 113.

The interior of the inner casing comprising the upper casing part 112*u* and the lower casing part 112*l* may be composed of a plurality of chambers 112*d*, each of which has a partition 112*c*, as in the multi channel pump of the first preferred embodiment of the present invention. Alternatively, the chambers 112*d* may be arranged in such a manner that the neighboring chambers have a common partition 112*c* to coaxially integrate all of the chambers. It is preferable that the number of the chambers 112*d* corresponds to the number of the tines 41 through which the dyes are discharged irrespective of whether the chambers 112*d* is the separated chambers or the integrated chambers. In the upper casing part 112*u* is formed an inlet 112*a*, and in the lower casing part 112*l* are formed a plurality of outlets 112*b*, the number of which corresponds to that of the tines 41. In the outer casing 111, in which the inner casing 112*u* and 112*l* is disposed, are formed an inlet 111*a*, which corresponds to the inlet 112*a* of the upper casing part 112*u*, and a plurality of outlets 111*b*, which correspond to the outlets 112*b* of the lower casing part 112*l*, respectively. To the outer surface of the outer casing 111 are attached brackets, which serve to support flexible flow channels. Each of the pumping elements 113 comprises a plurality of rotors 113*a* arranged on the same shaft. The pumping elements 113 are rotatably mounted in the inner casing 112*u* and 112*l* as in the pump 80 of the first preferred embodiment of the present invention. However, the pumping elements 113 are not connected to the motor 60 so that the axial force from the motor 60 is not transmitted to the pumping elements 113. The pumping elements 113 are operated by means of the pressure of the dyes discharged by the pump.

As shown in FIGS. 19 to 24, a single channel-multi pump system is adopted instead of the multi channel-multi pump system shown in FIGS. 2 to 4. The dispensers 140 are mounted in the head unit 30' of the hair dyeing device. It is possible to mount the dispensers 140 at required positions on a hydraulic circuit.

The dispensers 140 act as a substitute to the multi channel pump 80. Consequently, even though there exists resistance in the flow channel formed in any one of the tines 41, the pumping elements in the remaining flow channels serve as the motor to forcibly perform a pumping operation in the flow channel with the resistance so that the discharge amount of the dyes is uniformly maintained. In this way, the dyes discharged by each of the single pumps are uniformly distributed by force when passing through the multi channel dispensers 140.

As the hair dyeing device is equipped with the dispensers 140, the structure of the pump 80 is simplified as a single pump. The dispensers 140 and the single pumps together perform the same function as the multi channel pump. A trochoid pump, a rotary pump, or any other pump may be used. However, a gear pump system is advantageous considering design of the hair dyeing device based on a small size.

When assembling the hair dyeing device of the present invention, to the inlet 111*a* of the outer casing 111 is connected the flexible flow channel of the pump 80, and to the outlets 111*b* of the outer casing 111 are connected the upper ends of the flow channels formed in the tines 41.

Figure 24:
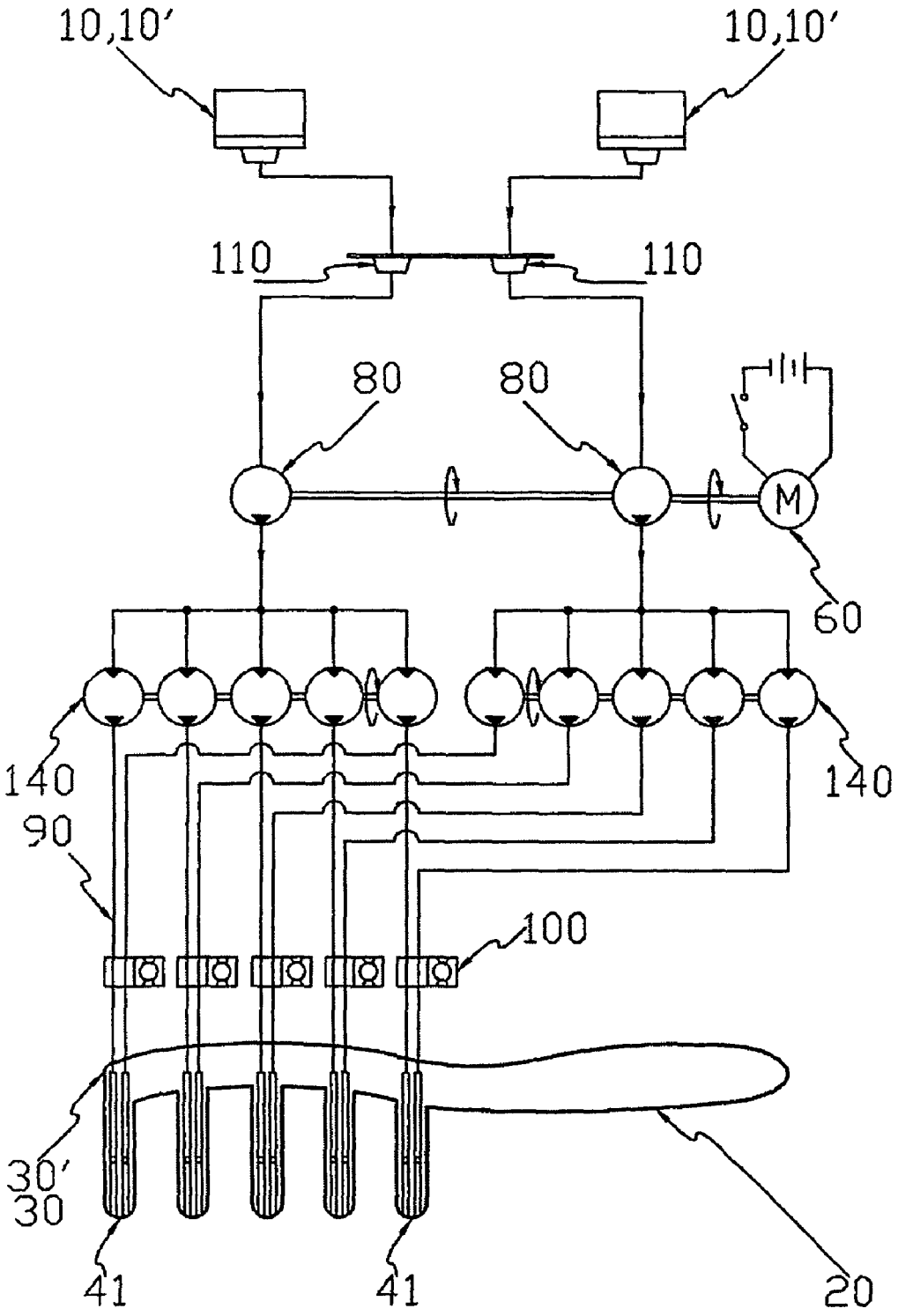
FIG. 24 is a hydraulic circuit diagram of the hair dyeing device of FIG. 19.

FIG. 24 is a hydraulic circuit diagram of the hair dyeing device according to the second preferred embodiment of the present invention, which is similar to FIG. 18. As shown in FIG. 24, the dispensers 140 are disposed between the pumps 80 and the comb assembly 40. It should be noted, however, that the provision of the dispensers 140 is dispensable. In the case that each of the pumps 80 is a multi channel pump, the construction as shown in FIG. 18 may be adopted.

Figure 19:
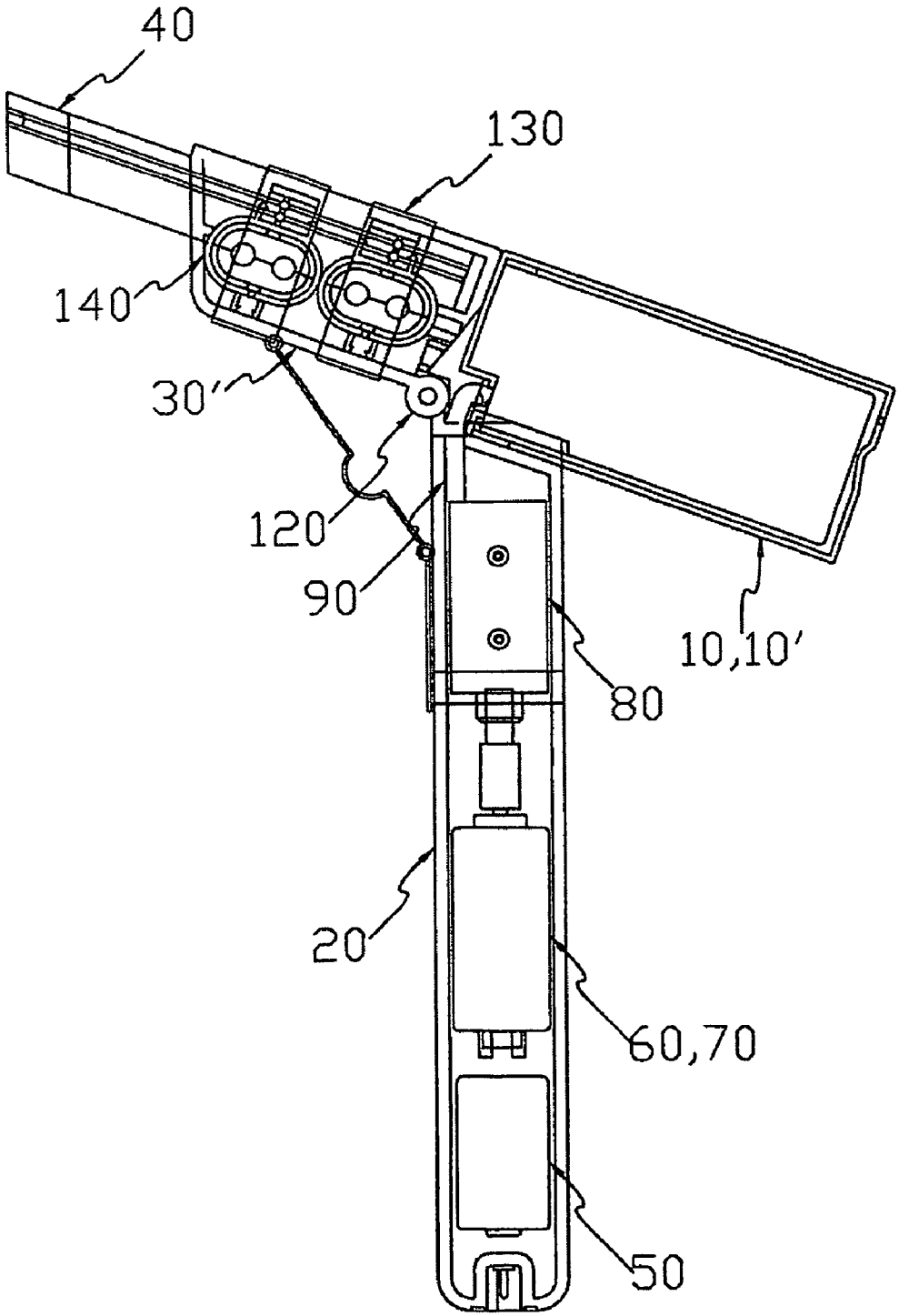
FIG. 19 is a side view, partially cut away, of a hair dyeing device according to a second preferred embodiment of the present invention showing the interior of the hair dyeing device.
Figure 20:
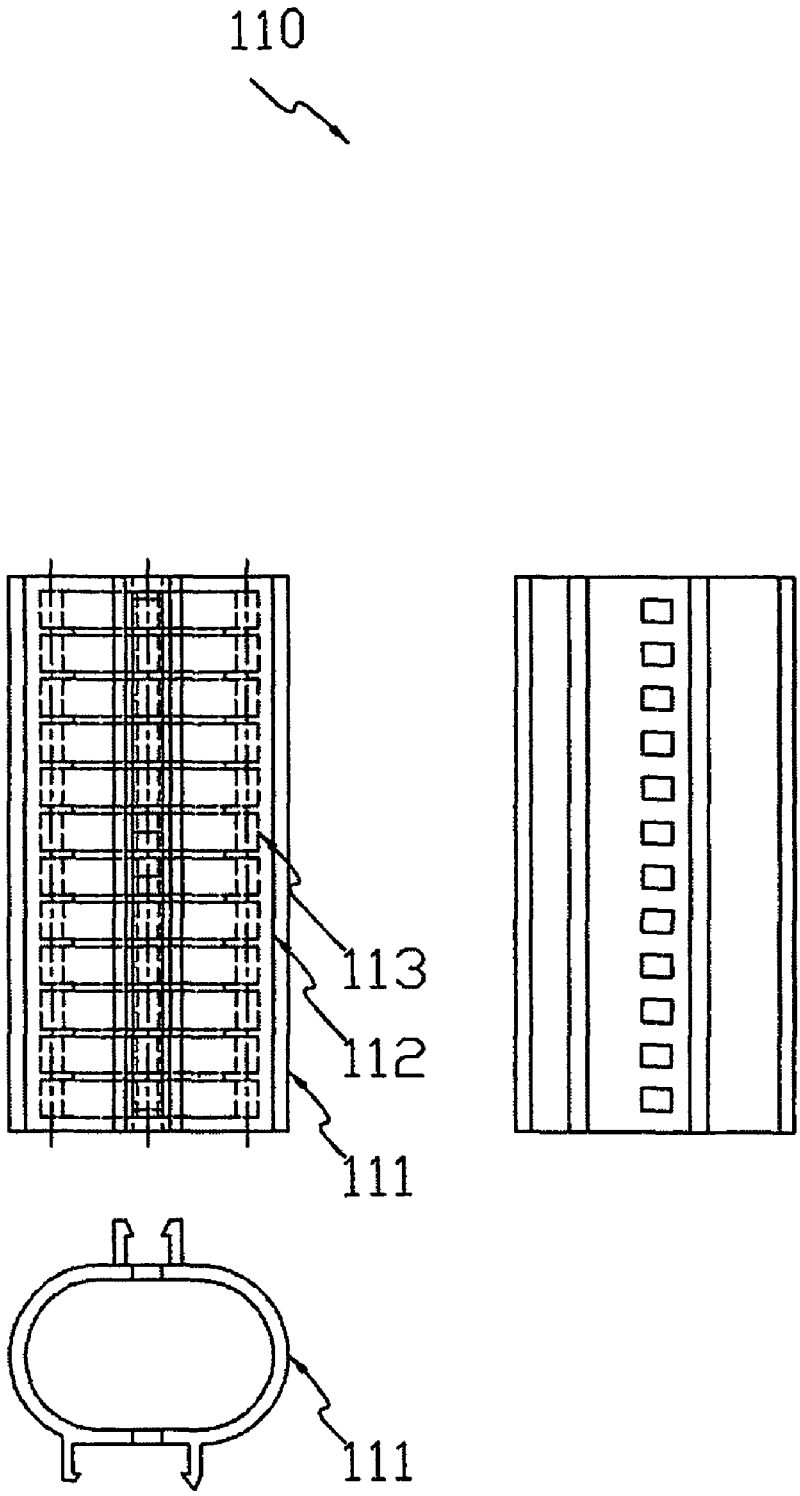
FIG. 20 is a view showing a multi channel dispenser of the present invention.
Figure 21:
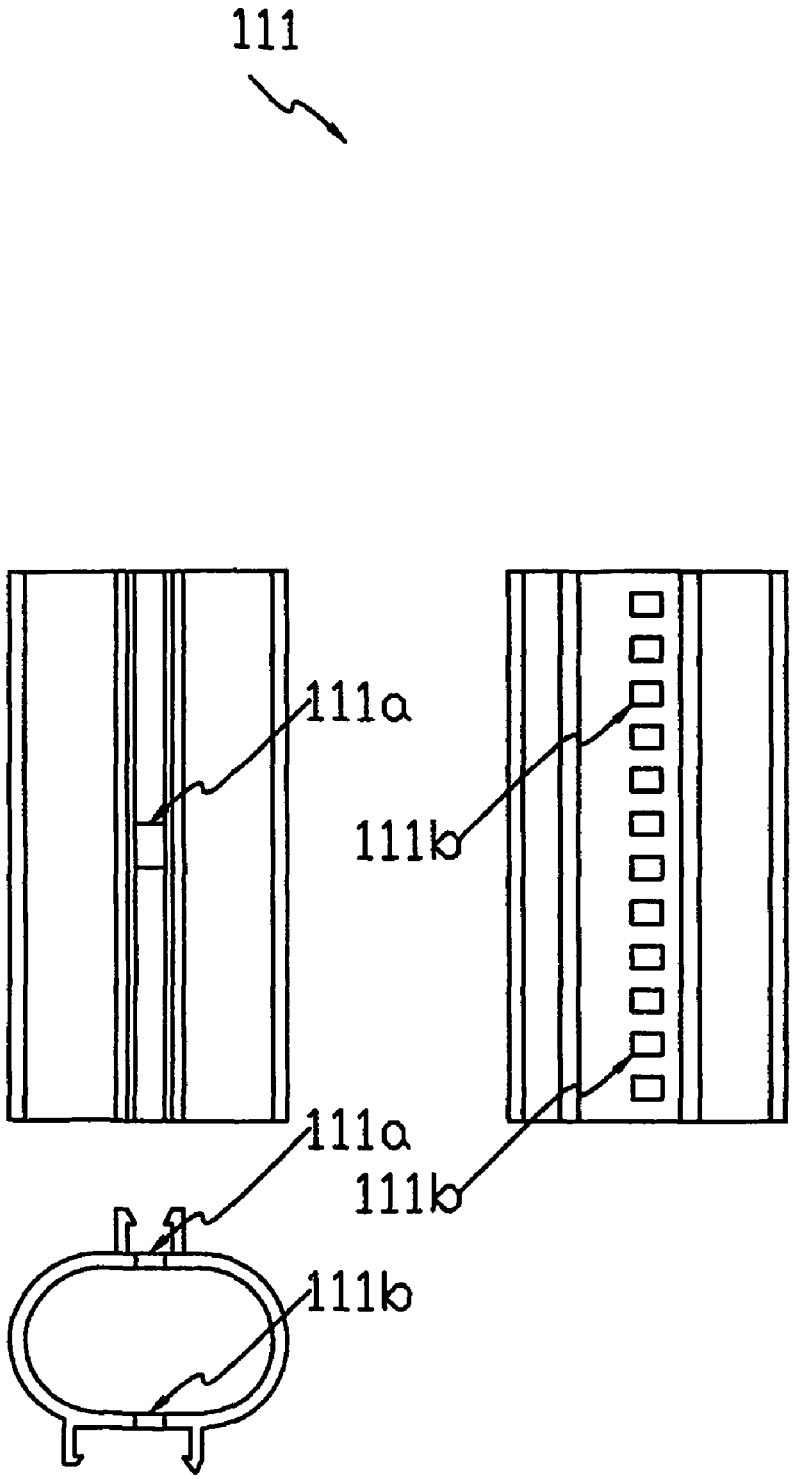
FIG. 21 is a projection view showing an outer casing of the multi channel dispenser of FIG. 20.
Figure 22:
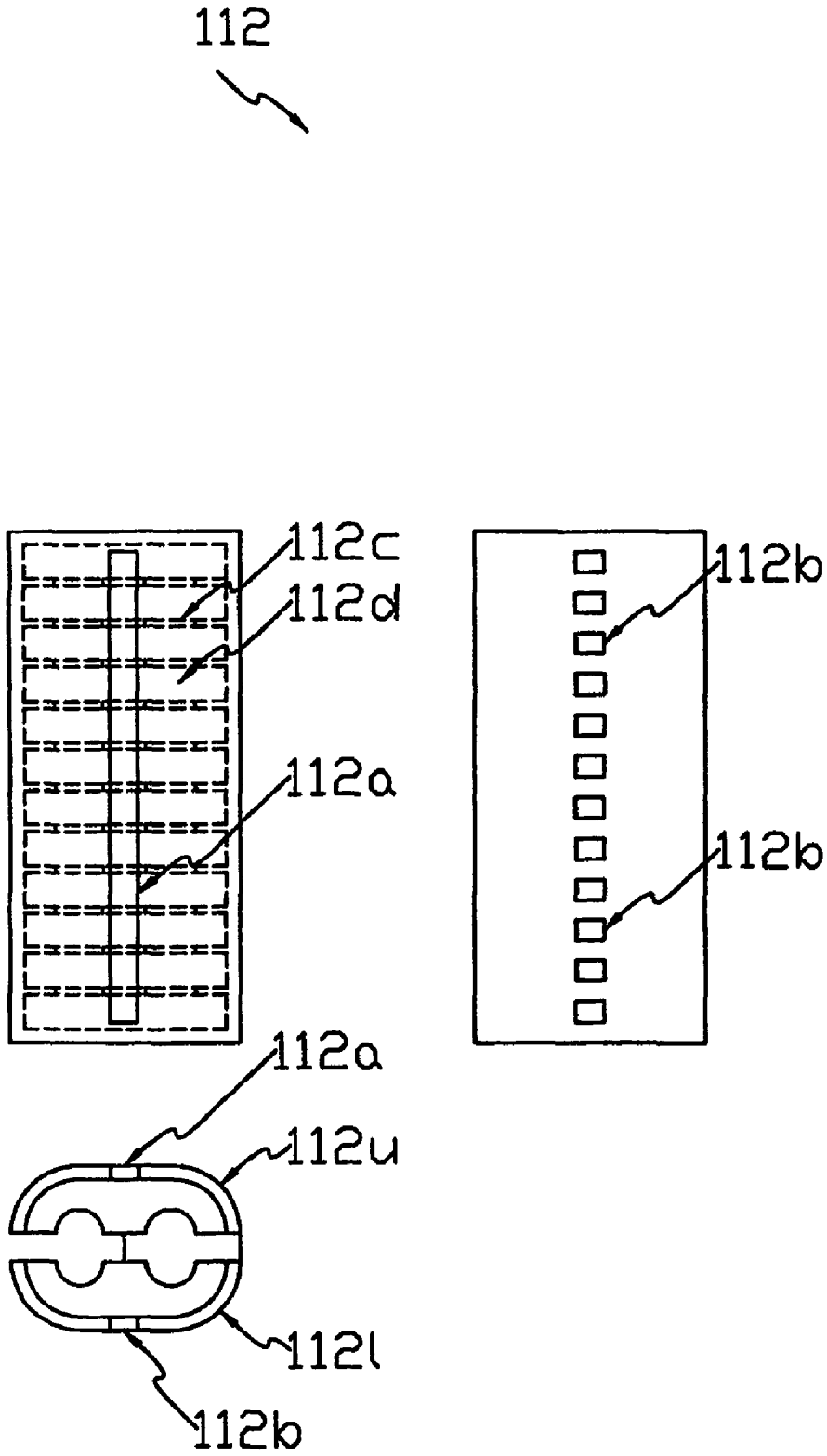
FIG. 22 is a projection view showing an inner casing of the multi channel dispenser of FIG. 20.
Figure 23:
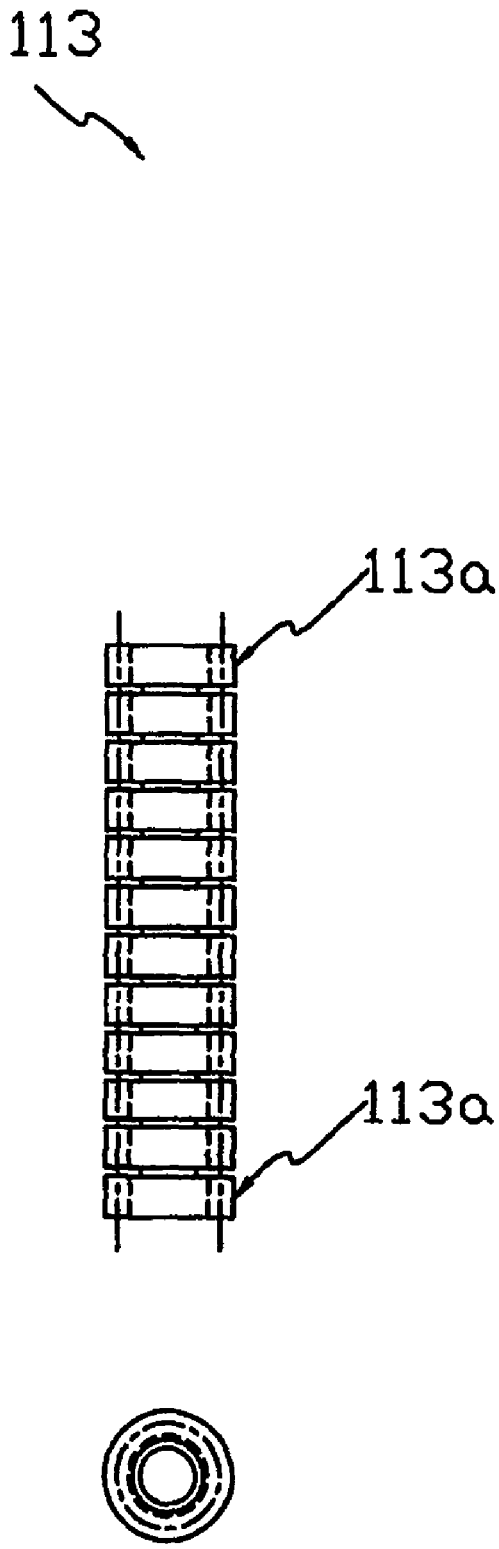
FIG. 23 is a projection view showing an rotor of the multi channel dispenser of FIG. 20.

The head unit 30' as shown in FIG. 19 is formed in a square shape, whereas the head unit 30 as shown in FIGS. 2 to 4 is formed in a round shape. Various dye containers with different shapes can be detachably attached to the main body 20 or the head unit 30 or 30' irrespective of the shape of the head unit 30 or 30' of the hair dyeing device.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

INDUSTRIAL APPLICABILITY

As apparent from the above description, the present invention provides a hair dyeing device which is capable of easily using all kinds of dye containers without difficulty of replacement of the dye containers so that selection of desired dyes (including decolorizers, stabilizers, developers, or coating agents) is easy and convenient when hair is to be dyed, for example, developed, colored, decolored, or coated permanently, semi-permanently, or temporarily, which is capable of easily control dyeing speed and dyeing pattern by controlling a power switch and a speed switch, and which is capable of uniformly discharging dyes supplied by pumps through flow channels formed in tines.

With the hair dyeing device of the present invention, the dyes can be extracted from the dye containers as much as desired or the same volumes of the dyes can be supplied. Furthermore, the dyes can be easily and conveniently supplemented while the hair is dyed, and the flow channels formed in the tines clogged by the dyes can be easily washed. Also, the skin of a user is not stained with the dyes, and introduction of the dyes into the eyes of the user is effectively prevented.

Moreover, the hair dyeing device of the present invention can be conveniently used by general consumers as well as beauty experts, and the hair dyeing device of the present invention can be easily and comfortably used as a general hair drier. Accordingly, the hair dyeing device of the present invention can meet not only special demands but also general demands.

The invention is:

1. A hair dyeing device for discharging dye by means of electric power to dye hair, comprising:

a main body having an electric motor, an electric power source, a switch, and a dye inlet port formed so that at least one dye container is attached to the main body through the dye inlet port;

a comb assembly attached to the main body, the comb assembly comprising a plurality of tines, each of the tines having at least one flow channel formed therein;

at least one pump connected to the dye inlet port and powered by the electric motor, the at least one pump providing an outside negative pressure at the dye inlet port for discharging the dye in the at least one dye container through the dye inlet port by sucking the hair dye out of the at least one dye container through the dye inlet port; and a plurality of flow channels formed so that the dye discharged from the dye inlet port flows to the respective tines along the corresponding flow channels, wherein the comb assembly is pivotably attached to one end of the main body.

2. The device as set forth in claim 1, wherein the dye container includes a dye-containing space for preventing contact between hair dye remaining in the dye container and filling air introduced into the dye container by discharging the hair dye, the dye-containing space being defined in a collapsible thin resin film, and at least one mouth disposed outside the dye-containing space, and wherein the pump provides the outside negative pressure at the at least one mouth to discharge the hair dye by sucking the hair dye out of the dye-containing space through the at least one mouth.

3. The device as set forth in claim 2, wherein dye container further includes at least one hole formed at an outside of the dye container and adjacent to the dye-containing space so that an inside negative pressure created by diminution of the hair dye is reduced.

4. The device as set forth in claim 1, wherein each of the tines of the comb assembly has one to eight flow channels formed therein.

5. The device as set forth in claim 1, wherein the at least one pump is a multi channel pump having a plurality of pumping elements divided by partitions, the pumping elements being coaxially arranged, and wherein the number of the pumping elements corresponds to that of the tines.

6. The device as set forth in claim 1, further comprising a valve mounted in each of the flow channels formed between the at least one pump and the comb assembly so that the dye is discharged through each of the flow channels while the dye is mixed with another dye or the dye is discharged through each of the flow channels while the dye is not mixed with another dye depending upon selected positions being chosen from among combinations of mixing-isolating-separating positions of the valve.

7. The device as set forth in claim 1, further comprising an intermediate plate attached to the dye inlet port so that the at least one dye container is easily replaced irrespective of the size of a mouth of the dye container.

8. The device as set forth in claim 1, further comprising a plurality of dispensers disposed between the at least one pump and the comb assembly for uniformly distributing the dye supplied by the at least one pump, wherein each of the dispensers has a plurality of rotors arranged on a same shaft.

* * * * *